US010439322B1

(12) United States Patent
Miller et al.

(10) Patent No.: US 10,439,322 B1
(45) Date of Patent: Oct. 8, 2019

(54) CONNECTOR SYSTEM FOR A WEARABLE ARTICLE

(71) Applicant: TE CONNECTIVITY CORPORATION, Berwyn, PA (US)

(72) Inventors: Keith Edwin Miller, Manheim, PA (US); Kyle Gary Annis, Hummelstown, PA (US); Kevin Michael Thackston, York, PA (US); Robert Neil Mulfinger, York Haven, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/997,897

(22) Filed: Jun. 5, 2018

(51) Int. Cl.

| | |
|---|---|
| ***H01R 4/58*** | (2006.01) |
| ***H01R 13/62*** | (2006.01) |
| ***H01R 13/66*** | (2006.01) |
| ***H01R 13/52*** | (2006.01) |
| *A41D 1/00* | (2018.01) |

(52) U.S. Cl.
CPC ..... *H01R 13/62* (2013.01); *H01R 13/5219* (2013.01); *H01R 13/665* (2013.01); *A41D 1/005* (2013.01)

(58) Field of Classification Search
CPC ..... H01R 4/58; H01R 4/64
USPC ..... 439/37
See application file for complete search history.

(56) References Cited

U.S. PATENT DOCUMENTS 5,657,201 A * 8/1997 Kochis ..... G06F 1/163 224/219
6,319,015 B1 * 11/2001 Faunce ..... H01R 11/22 24/662
7,462,035 B2 * 12/2008 Lee ..... H01R 12/592 439/121

* cited by examiner

*Primary Examiner* — Hien D Vu

(57) ABSTRACT

A connector system for a wearable article including receptacle and plug connector assemblies is provided. The receptacle connector assembly includes a housing having a cavity receiving an electronic device and having a receptacle connector. The plug connector assembly includes a holder including an article mount securable to the wearable article and a support arm hingedly coupled to the article mount at a hinge. The plug connector assembly has a plug connector on the support arm including plug contacts and a cable electrically connected to the plug contacts. A seal is coupled between the receptacle connector and the plug connector. The plug connector is loaded into a receptacle of the receptacle connector to mate the plug contacts with the receptacle contacts to electrically connect the cable to the electronic device.

17 Claims, 15 Drawing Sheets

CONNECTOR SYSTEM FOR A WEARABLE ARTICLE

BACKGROUND OF THE INVENTION

The subject matter described and/or illustrated herein relates generally to electrical connectors for wearable articles.

Connectors are sometimes integrated into clothing, apparel, and/or other wearable articles worn by an individual in a variety of different applications, such as, but not limited to, first responders (e.g. fire and police), maintenance technicians, soldiers, and/or the like. Known connectors that are integrated into wearable articles are not without problems. For example, in some environments, such as when the connectors are being used outside or in other harsh environments, contaminants such as dirt, mud, grease, sand, and/or other debris, and/or fluids such as water and/or oil may get trapped within a receptacle connector. Contaminants may enter the receptacle while the receptacle connector is disconnected from the complementary plug connector, or while the connectors are mated if the mating interface is not sealed. Such contaminants may contaminate the mating interface of the connector and/or otherwise impede mating of the plug and receptacle connectors, which for example may interrupt the electrical connection and/or damage the connector(s). Removal of such contaminants may be difficult and/or time consuming. For example, it may be difficult to clean the mating interface of a connector in the field. Moreover, attempting to clean the mating interface of a connector may damage of the conductors of the connector. For example, using tools, fingers, thumbs, cloths, and/or the like to remove the contaminants may damage the conductors. Some contaminants may be permanently trapped beneath the conductors of a connector.

Additionally, wearable connectors are typically subjected to harsh environments, such as wet and dirty environments. Sealing of the connectors is difficult. Electrical shielding of the connectors may be problematic.

A need remains for reliable electrical connectors for wearable articles.

BRIEF DESCRIPTION OF THE INVENTION

In an embodiment, a connector system for a wearable article is provided including a receptacle connector assembly and a plug connector assembly mated to the receptacle connector assembly. The receptacle connector assembly includes a housing having a cavity configured to removably receive an electronic device. The receptacle connector assembly has a receptacle connector configured to be electrically connected to the electronic device when received in the cavity. The receptacle connector has a receptacle and receptacle contacts in the receptacle being electrically connecting to the electronic device. The receptacle connector has a seal surface. The plug connector assembly includes a holder including an article mount configured to be secured to the wearable article and a support arm hingedly coupled to the article mount at a hinge of the holder. The plug connector assembly has a plug connector on the support arm including plug contacts and a seal surface. The plug connector has a cable electrically connected to the plug contacts and extending from the connector housing. A seal is coupled to one of the receptacle connector or the plug connector at the corresponding seal surface and engages the other of the receptacle connector and the plug connector at the corresponding seal surface. The plug connector is loaded into the receptacle of the receptacle connector to mate the plug contacts with the receptacle contacts to electrically connect the cable to the electronic device through the plug contacts and the receptacle contacts.

Optionally, the plug connector may include a plug shroud surrounding the plug contacts and the seal may be a perimeter seal surrounding an exterior of the plug shroud. The plug connector may include a base and a platform extending from the platform with the contacts extending along the platform and the base holding the seal. The receptacle connector may have a mating edge defining the seal surface configured to engage the seal when the platform is plugged into the receptacle.

Optionally, the plug connector is mated to the receptacle connector in a mating direction. The plug connector may have an angled mating interface angled transverse to the mating direction. The receptacle connector may have an angled mating interface angled transverse to the mating direction.

Optionally, the receptacle connector may include a printed circuit board in the receptacle having circuits defining the receptacle contacts. The plug contacts may have spring beams configured to be spring biased against the receptacle contacts. Optionally, the plug connector may include a printed circuit board having circuits defining the plug contacts configured to be plugged into the receptacle. The receptacle contacts may have spring beams configured to be spring biased against the plug contacts.

Optionally, at least one of the plug connector and the receptacle connector may include an electrical shield providing electrical shielding for the mating interface between the plug contacts and the receptacle contacts. Optionally, the receptacle may include a window allowing debris to be ejected from the receptacle.

Optionally, the support arm may be docked in the housing and releasably secured to the housing to secure the plug connector to the receptacle connector. The plug connector may be side loaded into the receptacle parallel to the cavity. The plug connector may be rear loaded into the receptacle perpendicular to the cavity. Optionally, the article mount may include a clip for mounting the holder to the wearable article.

Optionally, the cable may exit the holder through the hinge. The hinge may extend along a hinge axis and the cable may be routed through the hinge along the hinge axis. The cable may include a flex circuit.

Optionally, the receptacle connector assembly may include a mating connector held by the housing in the cavity for interfacing with the electronic device and the mating connector may be electrically connected to the receptacle contacts. The cavity may be open at a top of the housing to receive the electronic device. The receptacle may be provided at a bottom of the housing. Optionally, the housing may include a mounting plate and the electronic device may be mounted to the mounting plate. The housing may include a window exposing the electronic device through the window.

Optionally, the holder may be movable between an open position and a closed position. The housing may be positioned between the support arm and the article mount in the closed position such that the cavity of the housing faces the article mount and the electronic device is inaccessible in the closed position. The support arm may be moved away from the article mount to expose the cavity of the housing in the open position such that the electronic device is accessible in the open position.

DETAILED DESCRIPTION OF THE INVENTION

Figure 1:
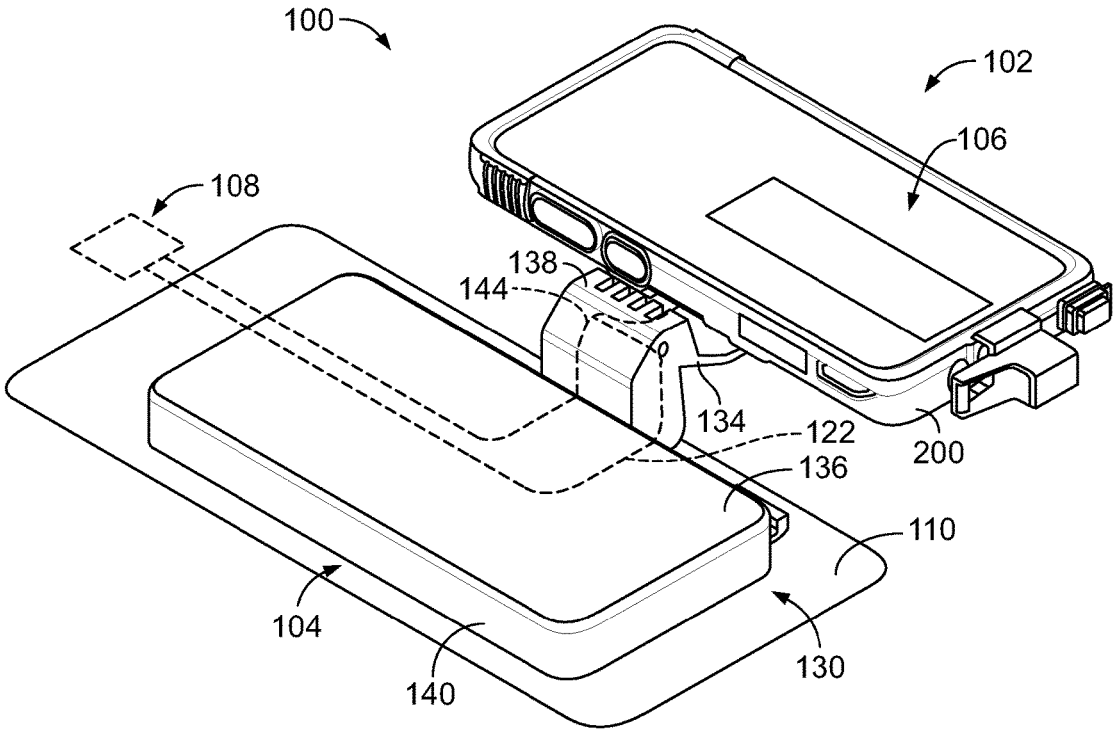
FIG. 1 is a perspective view of a connector system in accordance with an exemplary embodiment in an open position including a receptacle connector assembly and a plug connector assembly.
Figure 2:
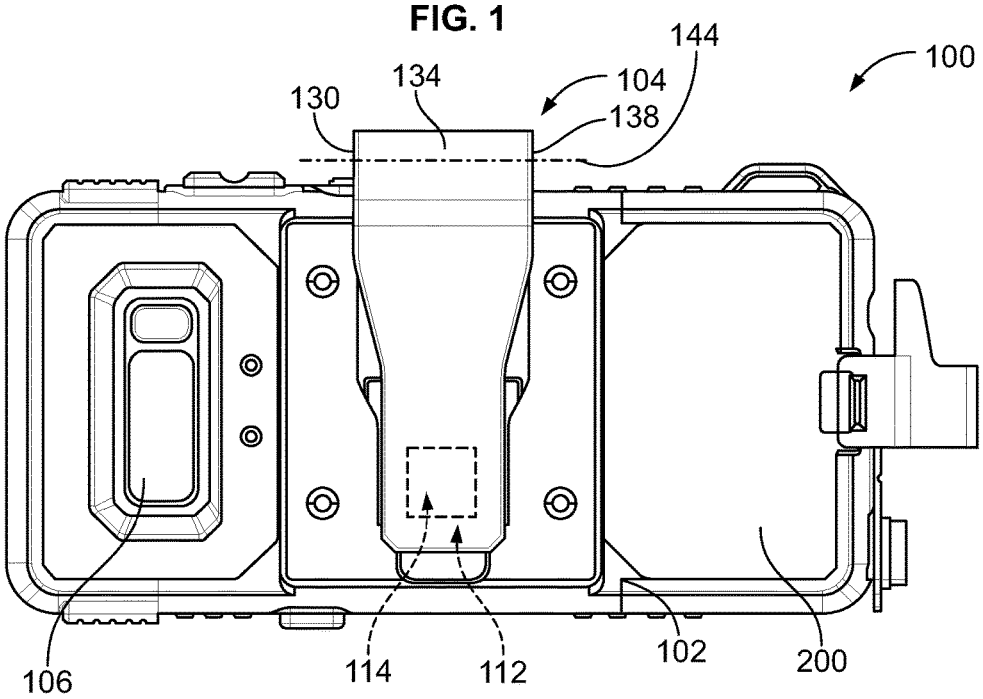
FIG. 2 is a top view of the connector system in accordance with an exemplary embodiment in a closed position.
Figure 3:
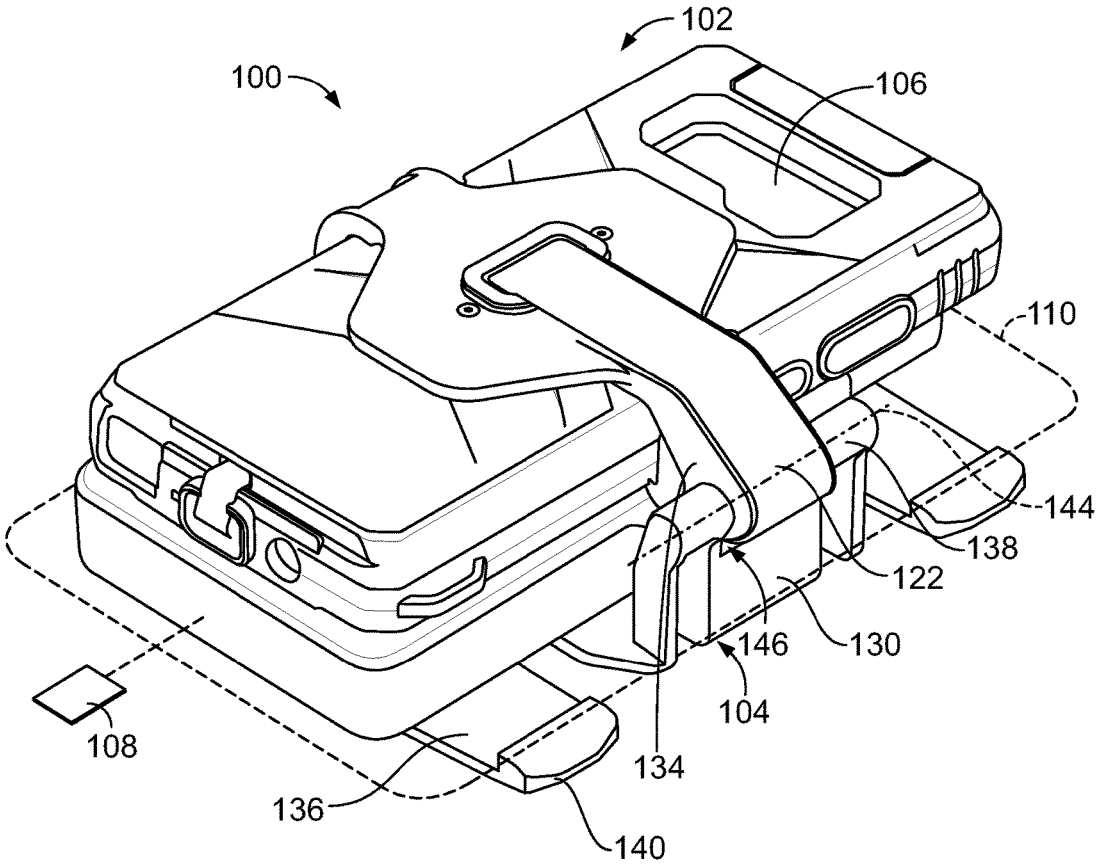
FIG. 3 is a perspective view of the connector system in accordance with an exemplary embodiment.

FIG. 1 is a perspective view of a connector system 100 in accordance with an exemplary embodiment in an open position. FIG. 2 is a top view of the connector system 100 in accordance with an exemplary embodiment in a closed position. FIG. 3 is a perspective view of the connector system 100 in accordance with an exemplary embodiment. The connector system 100 includes a receptacle connector assembly 102 and a plug connector assembly 104 that mate together to form an electrical and/or fiber optic connection therebetween. In the illustrated embodiment, the plug connector assembly 104 is configured to be mounted to a user, such as to a wearable article 110 worn by the user, and the receptacle connector assembly 102 is removably coupled to the wearable article 110 by the plug connector assembly 104.

The connector system 100 is provided along an electrical and/or fiber optic path between two electronic devices 106 and 108 for providing a separable electrical and/or fiber optic connection between the devices 106, 108. The connector system 100 is optionally mounted to any type of wearable article 110, such as, but not limited to, a vest, a shirt, a jacket, pants, trousers, a boot, a shoe, a helmet, a hat, a cap, a coat, armor, a backpack, and/or the like worn by an operator, such as military personnel, a first responder, and the like. Optionally, the connector system 100 may form part of wearable technology, such as e-textiles. The connector system 100 may be configured to operate at any standard, protocol, and/or the like, such as, but not limited to, USB 1.0, USB 2.0, USB 3.0, CAN-BUS, GIGA-BIT ETHERNET, and/or the like. The connector system 100 may be scalable to a variety of different sizes. In an exemplary embodiment, the connector system 100 is used to electrically connect a cell phone (first electronic device 106) with another component worn by the operator.

The devices 106 and 108 each may be any type of electronic, fiber optic, and/or other type of device. In one exemplary embodiment, the device 106 is a portable electronic device, such as a cell phone and the device 108 is a battery pack, a communication system, or another type of electronic device. Other types of devices may be interconnected by the connector system 100 in other embodiments.

In an exemplary embodiment, the receptacle connector assembly 102 includes a receptacle connector 112 (FIG. 2) and the plug connector assembly 104 includes a plug connector 114 (FIG. 2). The plug connector 114 is electrically connected to the receptacle connector 112 when the plug connector assembly 104 is mated with the receptacle connector assembly 102.

In the illustrated embodiment, the plug connector assembly 104 terminates one or more cables 122 of the wearable article 110. The cables 122 connect the plug connector assembly 104 to the device 108 and are worn by the operator. The cable 122 may be a round cable having one or more wires therein. In other various embodiments, the cable 122 may be a flat cable. In various embodiments, the cable 122 may be a flex circuit. In the illustrated embodiment, the cable 122 is separate from the wearable article 110; however the cable 122 may be embedded in the wearable article 110. In other embodiments, the cable 122 may be an e-textile. The plug connector assembly 104 is mounted to the wearable article 110. For example, the wearable article 110 may be clothing, a mechanical device such as a clip or bracket worn by the user, an electrical device worn by the user, or another type of wearable article. In other various embodiments, the wearable article 110 may be a strap, belt or other component that supports the plug connector assembly 104. The wearable article 110 may be a backpack or other component carried by the operator.

The plug connector assembly 104 includes a holder 130 supporting a housing 200 of the receptacle connector assembly 102. In the illustrated embodiment, the holder 130 includes multiple pieces movable relative to each other. For example, the holder 130 includes a support arm 134 and an article mount 136. The support arm 134 extends from the article mount 136. In an exemplary embodiment, the support arm 134 is hingedly coupled to the article mount 136 at a hinge 138 of the holder 130. The article mount 136 is configured to be mounted to the wearable article 110. For example, the article mount 136 may include a clip or other mounting structure configured to be secured to the wearable article 110. The support arm 134 may be pivoted to open and close the connector system 100, such as to access the electronic device 106 or restrict access to the electronic device 106, respectively.

The support arm 134 is used to support the receptacle connector assembly 102 and/or the electronic device 106. For example, the receptacle connector assembly 102 may be removably secured to the support arm 134, such as clipped into the support arm, latched to the support arm 134 or otherwise secured to the support arm 134. In various embodiments, the support arm 134 supports the housing 200, which supports the electronic device 106. In an exemplary embodiment, the support arm 134 holds the plug connector 114 and the housing 200 holds the receptacle connector 112. When the housing 200 is coupled to the support arm 134, the plug connector 114 is mated with the receptacle connector 112.

The article mount 136 includes a base 140 used to secure the holder 130 to the wearable article 110. Optionally, the base 140 may house or be part of an electronic device and the cable 122 may be electrically connected to the electronic device in the base 140. In an exemplary embodiment, the base 140 may be released from the wearable article 110 to remove the plug connector assembly 104 from the wearable article 110. Alternatively, the article mount 136 may be integrated into the wearable article 110. For example, the article mount 136 may be sown into one or more layers of the wearable article 110. For example, the base 140 may be a patch or other element configured to be sown into the wearable article 110.

The hinge 138 extends along a hinge axis 144. The support arm 134 is rotatably coupled to the article mount 136 at the hinge 138. Optionally, the hinge 138 may include a cable channel 146 that receives the cable 122. As such, the cable 122 is routed along the hinge 138 from the article mount 136 to the support arm 134. The cable 122 is protected in the cable channel 146, such as from snagging. Additionally, the cable 122 does not restrict opening and closing of the support arm 134 and does not bind when the support arm 134 is opened and closed. Additionally, routing the cable 122 in the cable channel 146 prevents over bending of the cable 122 beyond a bend limit of the cable 122 by controlling routing of the cable 122 away from the plug connector 114. In various embodiments, the cable 122 may be routed along the pivot axis (for example, parallel to the pivot axis). In other various embodiments, the cable 122 may extend across the hinge 138 between the support arm 134 and the article mount 136.

Figure 4:
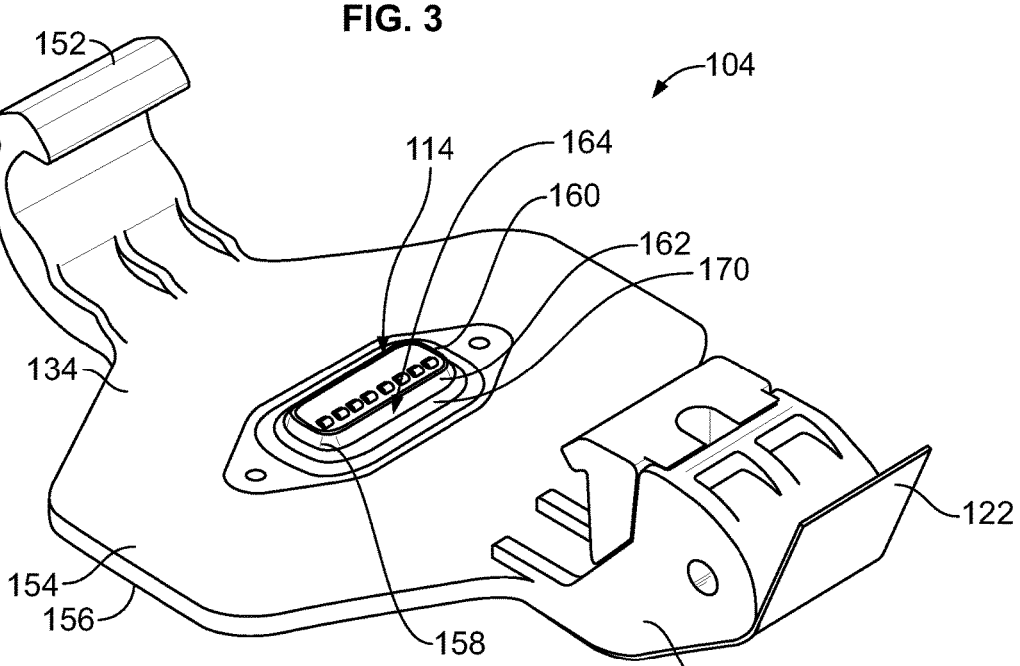
FIG. 4 is a perspective view of a portion of the plug connector assembly of the connector system in accordance with an exemplary embodiment.

FIG. 4 is a perspective view of a portion of the plug connector assembly 104 showing the plug connector 114 in accordance with an exemplary embodiment. The plug connector 114 is provided on the support arm 134. The support arm 134 includes a base 150 and extends to a distal end 152. The support arm 134 includes a top 154 and a bottom 156. In the illustrated embodiment, the plug connector 114 is provided on the top 154 between the base 150 and the distal end 152. The plug connector 114 may be provided at other locations in alternative embodiments. For example, the plug connector 114 may be provided at the base 150 or at the distal end 152 in alternative embodiments. The plug connector 114 may be provided on the bottom 156 in various embodiments. In the illustrated embodiment, the support arm 134 is generally C-shaped and defines a channel that receives the receptacle connector assembly 102. For example, the support arm 134 may define a clip that receives the receptacle connector assembly 102. The plug connector 114 may accommodate pivoted or rotated mating into the support arm 134 by the receptacle connector assembly 102.

In an exemplary embodiment, the plug connector 114 is separate and discrete from the support arm 134 and coupled thereto. Alternatively, the plug connector 114 may be integral with and defined by the support arm 134. For example, the support arm 134 may be molded to form the plug connector 114. The plug connector 114 includes a shroud 158 extending from the top 154 of the support arm 134. The shroud 158 defines a plug configured to be plugged into the receptacle connector 112. The plug connector 114 includes plug contacts 160 at a mating interface configured to be mated with the receptacle connector 112. The plug contacts 160 are configured to be electrically connected to the receptacle connector 112. The plug contacts 160 are electrically connected to the cable 122. In an exemplary embodiment, the plug connector 114 includes a printed circuit board and the plug contacts 160 are terminated to the printed circuit board (for example, soldered or press-fit) and the cable 122 is terminated to the printed circuit board (for example, soldered). In other various embodiments, the plug contacts 160 are terminated directly to the cable 122. In an exemplary embodiment, the plug contacts 160 include spring beams being deflectable and configured for mating with the receptacle connector 112. Other types of contacts may be provided in alternative embodiments, such as Pogo pins, pads, and the like. In other various embodiments, the plug connector 114 may include a circuit board having circuits defining the plug contacts 160. In other various embodiments, the plug connector 114 may be provided without the printed circuit board, such as including stamped and formed contacts that are overmolded or loaded into a pre-molded contact holder.

In an exemplary embodiment, the plug connector 114 has space around the plug contacts 160 that allows removal of dirt and debris from the plug contacts 160. For example, a tool or cloth may be used to clean or wipe the plug contacts 160. There may be adequate space within the shroud 158 to clean the plug contacts 160. Optionally, the plug connector 114 may be open below the plug contacts 160 to allow the dirt and debris to be ejected through the bottom such that the dirt and debris does not gather in the plug connector 114. In other various embodiments, the shroud 158 may be closed off, such as using a cap or cover, around the plug contacts 160 to limit ingress of dirt or debris into the shroud and the exposed mating ends of the plug contacts 160 are configured to be wiped clean at the top surface of the plug connector 114.

In an exemplary embodiment, the plug connector 114 includes an electrical shield 162 at least partially surrounding the plug contacts 160. The electrical shield 162 provides electrical shielding for the plug contacts 160 at the mating interface. The electrical shield 162 may be a machined, diecast, or stamped and formed shield coupled to the support arm 134 and/or the shroud 158. In alternative embodiments, the electrical shield 162 is defined by conductive plating provided on the support arm 134 and/or the shroud 158 rather than a separate machined part.

The plug connector 114 has a seal surface 164 that may be sealed to provide a sealed interface with the receptacle connector 112. In the illustrated embodiment, the seal surface 164 is defined on the exterior of the shroud 158. The plug connector assembly 104 includes a seal 170 at the seal surface 164. The seal 170 surrounds the plug contacts 160 to provide a sealed mating interface for mating with the receptacle connector assembly 102. The seal 170 may be a perimeter seal extending entirely around the perimeter of the mating interface. The seal 170 may be an interface seal on the support arm 134. The seal 170 may be a rubber gasket. In an alternative embodiment, the seal 170 may be provided on the receptacle connector assembly 102 rather than the plug connector assembly 104.

The plug connector assembly 104 may include a latching feature (not shown) for latchably securing the plug connector assembly 104 to the receptacle connector assembly 102. The plug connector assembly 104 may include a release mechanism (not shown), such as a push button or a pull tab to release the latching feature from the receptacle connector assembly 102, such as for releasing the receptacle connector assembly 102 from the plug connector assembly 104.

Figure 5:
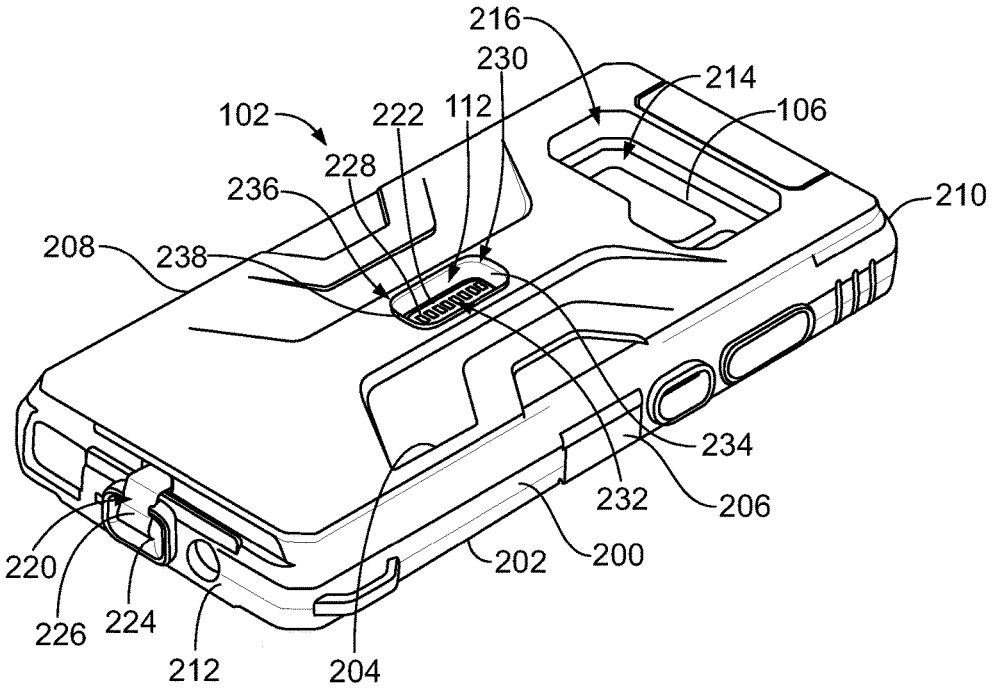
FIG. 5 is a rear perspective view of the receptacle connector assembly of the connector system in accordance with an exemplary embodiment.
Figure 6:
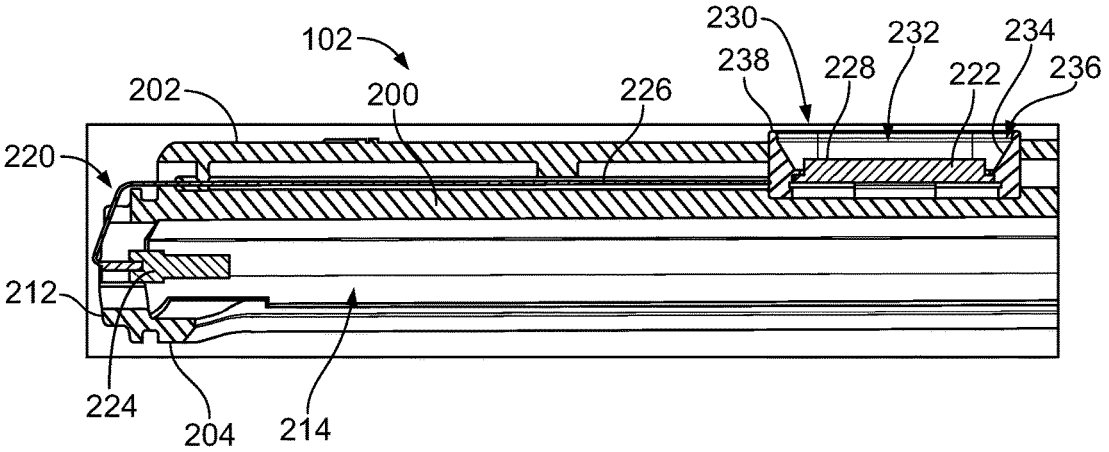
FIG. 6 is a cross sectional view of a portion of the receptacle connector assembly in accordance with an exemplary embodiment.

FIG. 5 is a rear perspective view of the receptacle connector assembly 102 in accordance with an exemplary embodiment. FIG. 6 is a cross sectional view of a portion of the receptacle connector assembly 102 in accordance with an exemplary embodiment. The receptacle connector assembly 102 includes the housing 200 that receives the first electronic device 106. Optionally, the first electronic device 106 may be held in a case and the housing 200 may receive the first electronic device 106 and the case. The housing 200 includes a top 202 and a bottom 204 opposite the top 202. The housing 200 includes a first side 206 and a second side 208 opposite the first side 206. The housing 200 includes a first end 210 and a second end 212 opposite the first end 210.

The housing 200 includes a cavity 214 that receives the electronic device 106. The cavity 214 may be open at the top 202 (for example, see FIG. 1) and/or the first end 210 for receiving the electronic device 106. In an exemplary embodiment, the cavity 214 is open at the top 202 to access the electronic device 106 when the electronic device 106 is received in the housing 200. For example, in the illustrated embodiment, the electronic device 106 is a cell phone and the touchscreen of the cell phone is accessible through the top 202. In an exemplary embodiment, the housing 200 includes a window 216 at the bottom 204. The window 216 provides access to the electronic device 106. For example, the window 216 may provide access for a camera, a flash a light, or another feature of the electronic device 106.

In an exemplary embodiment, the receptacle connector assembly 102 includes a connector assembly 220 providing an electrical interface between the plug connector assembly 104 and the electronic device 106. The connector assembly 220 includes the receptacle connector 112. In the illustrated embodiment, the receptacle connector 112 includes a printed circuit board 222; however, the receptacle connector 112 may include other electrical components, such as a flexible circuit, contacts, and the like. In an exemplary embodiment, the connector assembly 220 includes a mating connector 224 and a cable 226 connecting the printed circuit board 222 and the mating connector 224. The cable 226 may be a jacketed cable having one or more wires therein. Alternatively, the cable 226 may be a flat cable, such as a flex circuit. In alternative embodiments, rather than having a cable between the printed circuit board 222 and the mating connector 224, the mating connector 224 may be mounted directly to the printed circuit board 222. The mating connector 224 has a mating interface for electrical connection with the electronic device 106, such as a cell phone interface, a USB interface, and the like.

The printed circuit board 222 may include circuitry and/or electrical components for processing signals and/or power between the cable 122 and the electronic device 106. In an exemplary embodiment, the printed circuit board 222 includes receptacle contacts 228 defining a mating interface 230 for mating with the plug connector assembly 104. For example, the receptacle contacts 228 may be defined by circuits, such as pads, traces or vias on the printed circuit board 222. Alternatively, the receptacle contacts 228 may be spring contacts or other types of contacts terminated to the printed circuit board 222. In alternative embodiments, rather than using a printed circuit board 222, the housing 200 may hold a mating connector for mating with the plug connector assembly 104.

The housing 200 includes a receptacle 232 at the bottom 204 for receiving the plug connector 114 of the plug connector assembly 104. The receptacle 232 is defined by sidewalls 234. In an exemplary embodiment, the receptacle 232 is open at the bottom 204 of the housing 200 for rear loading the plug connector 114 into the receptacle 232 in a direction generally perpendicular to the cavity 214. In an alternative embodiment, the receptacle 232 is open at the first side 206 of the housing 200 for side loading the plug connector 114 into the receptacle 232 in a direction generally parallel to the cavity 214. The receptacle 232 may be located at other positions and/or in other orientations in alternative embodiments. In an exemplary embodiment, the sidewalls 234 may be angled to provide lead-in and guidance for mating with the plug connector 114. For example, the sidewalls 234 may provide a large catch window to allow pivoting mating of the plug connector 114 into the receptacle 232 and ensure alignment of the connectors when fully mated.

The housing 200 includes an opening 236 that provides access to the printed circuit board 222. The contacts 228 are exposed in the opening 236 for mating with the plug connector assembly 104. In an exemplary embodiment, the sidewalls 234 define a seal surface 238 configured to engage the seal 170 (shown in FIG. 3). In various embodiments, the receptacle 232 may include a lead-in to guide the plug connector 114 into the receptacle 232 during mating. The lead-in makes blind mating of the receptacle connector assembly 102 with the plug connector assembly 104 easier and may accommodate pivoting or mating at various angles. The receptacle connector assembly 102 may include other alignment features or guide features to guide mating with the plug connector assembly 104. In an exemplary embodiment, the receptacle connector assembly 102 may include a latching feature (not shown) for interfacing with the plug connector assembly 104 to secure the plug connector assembly 104 to the receptacle connector assembly 102.

Figure 7:
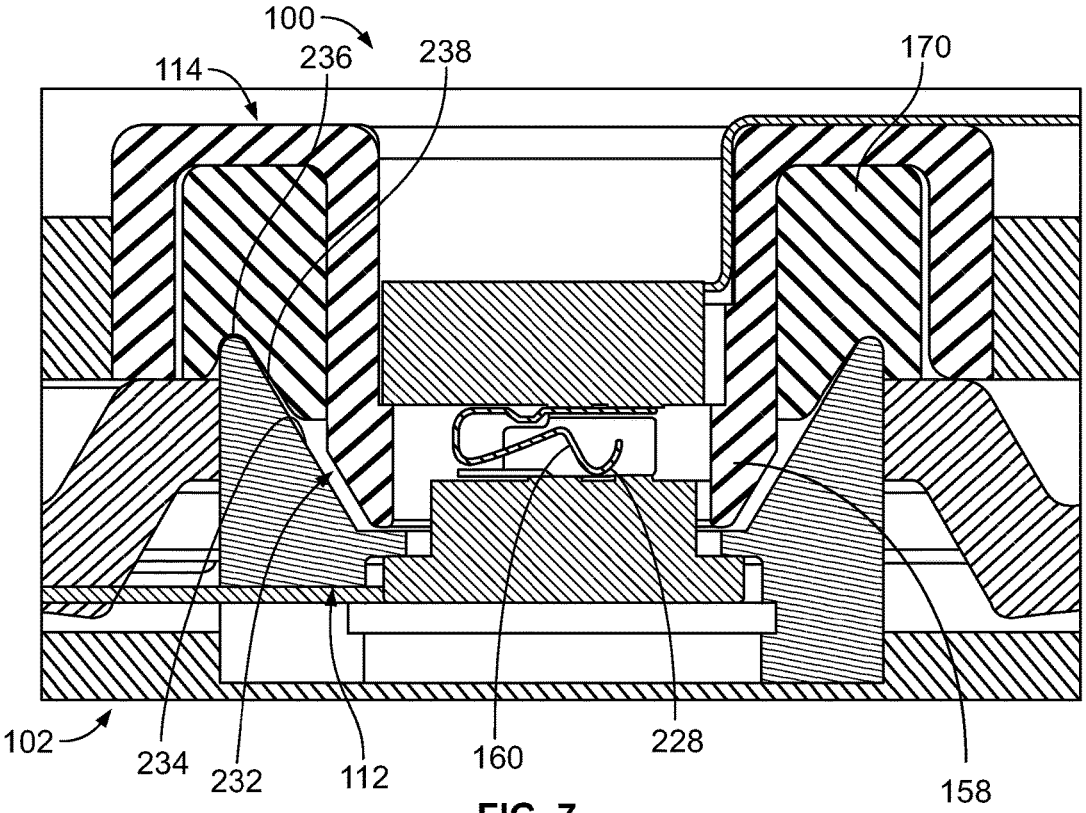
FIG. 7 is a cross-sectional view of the connector system in accordance with an exemplary embodiment.
Figure 8:
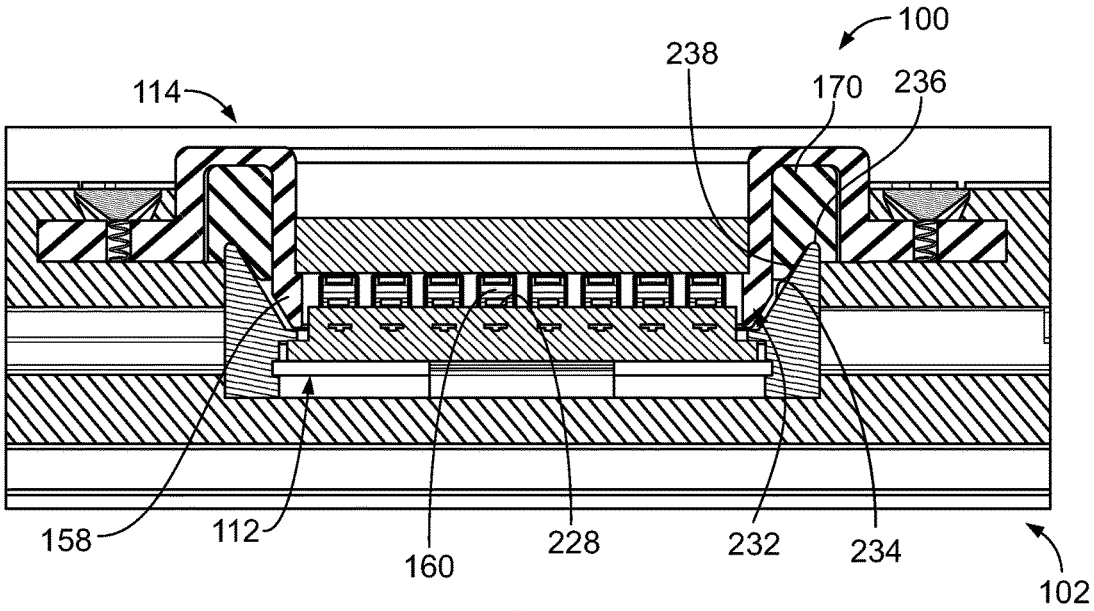
FIG. 8 is a cross sectional view of the connector system in accordance with an exemplary embodiment.

FIG. 7 is a cross-sectional view of the connector system 100 in accordance with an exemplary embodiment. FIG. 8 is a cross sectional view of the connector system 100 in accordance with an exemplary embodiment. FIGS. 7 and 8 illustrate the plug connector 114 mated with the receptacle connector 112. When mated, the plug connector 114 is plugged into the receptacle 232 and electrically connected with the receptacle connector 112. The plug contacts 160 are mated with the receptacle contacts 228. When mated, the seal surface 238 of the receptacle connector assembly 102 engages the seal 170. The seal 170 is compressed against the edge 236 to seal the mating interface. In the illustrated embodiment, the sidewalls 234 are angled to guide loading of the plug connector 114 into the receptacle 232. Optionally, the leading edge of the shroud 158 may be angled for mating with the receptacle connector 112.

Figure 9:
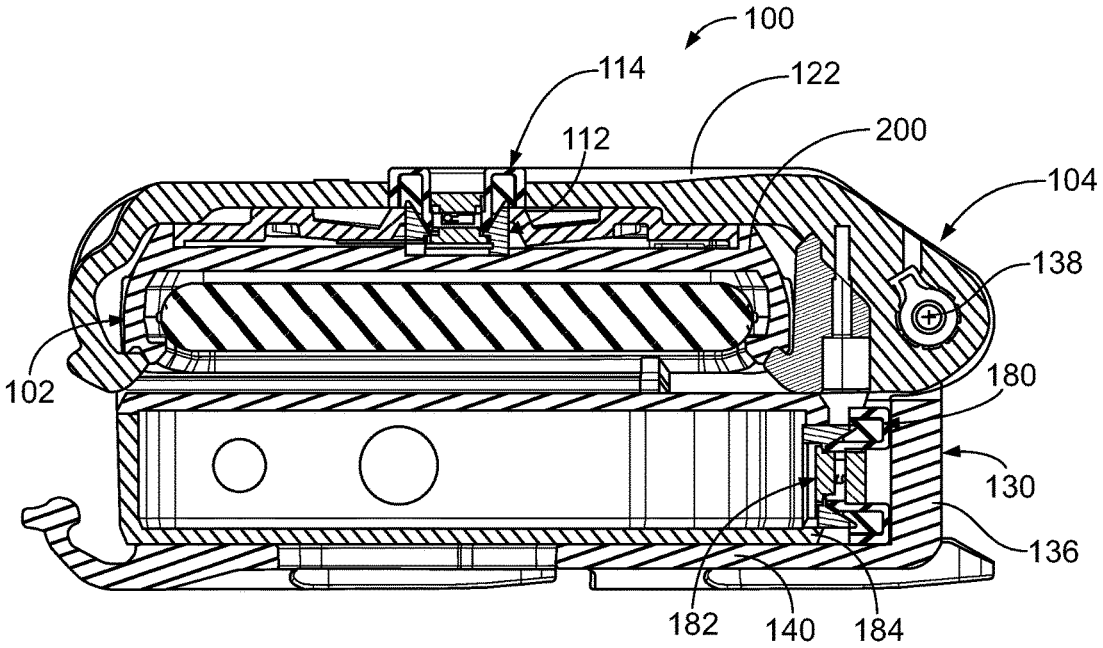
FIG. 9 is a cross-sectional view of the connector system in accordance with an exemplary embodiment.

FIG. 9 is a cross-sectional view of the connector system 100 in accordance with an exemplary embodiment showing the receptacle connector assembly 102 and the plug connector assembly 104. The housing 200 is shown coupled to the holder 130. The plug connector 114 is shown connected to the receptacle connector 112. The cable 122 is routed from the plug connector 114, along the hinge 138 to the article mount 136. In an exemplary embodiment, the cable 122 is terminated to a second plug connector 180 held by the base 140. Optionally, the second plug connector 180 may be similar to or identical to the plug connector 114. The second plug connector 180 is configured to be mated with a receptacle connector 182. In the illustrated embodiment, the receptacle connector 182 is part of a removable element 184 of the article mount 136. The removable element 184 may be an electronic device, such as a battery, a communication system or another electronic device. The removable element 184 may include electronics electrically connected to the receptacle connector 182.

Figure 10:
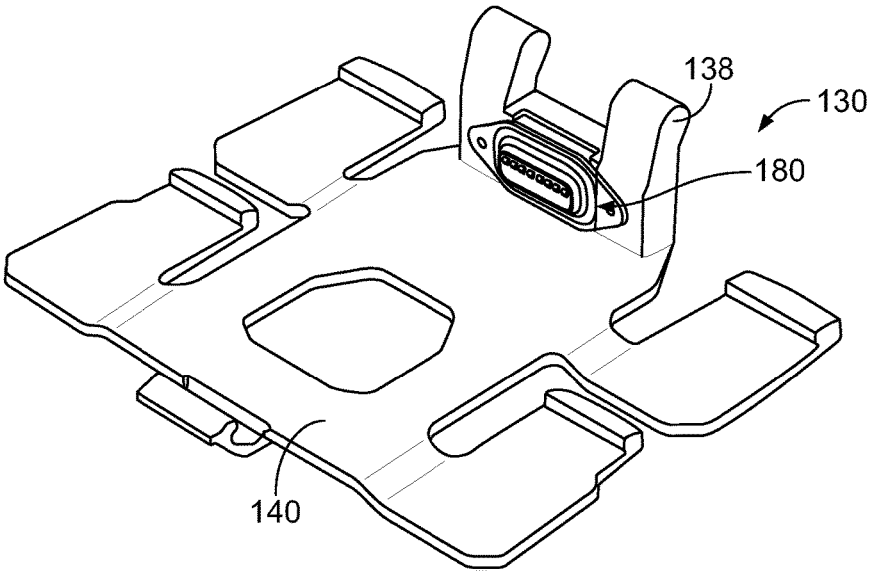
FIG. 10 is a perspective view of a portion of a holder of the connector system in accordance with an exemplary embodiment.

FIG. 10 is a perspective view of a portion of the holder 130 showing the base 140 without the removable element 184. The base 140 holds the plug connector 180. The base 140 forms part of the hinge 138.

Figure 11:
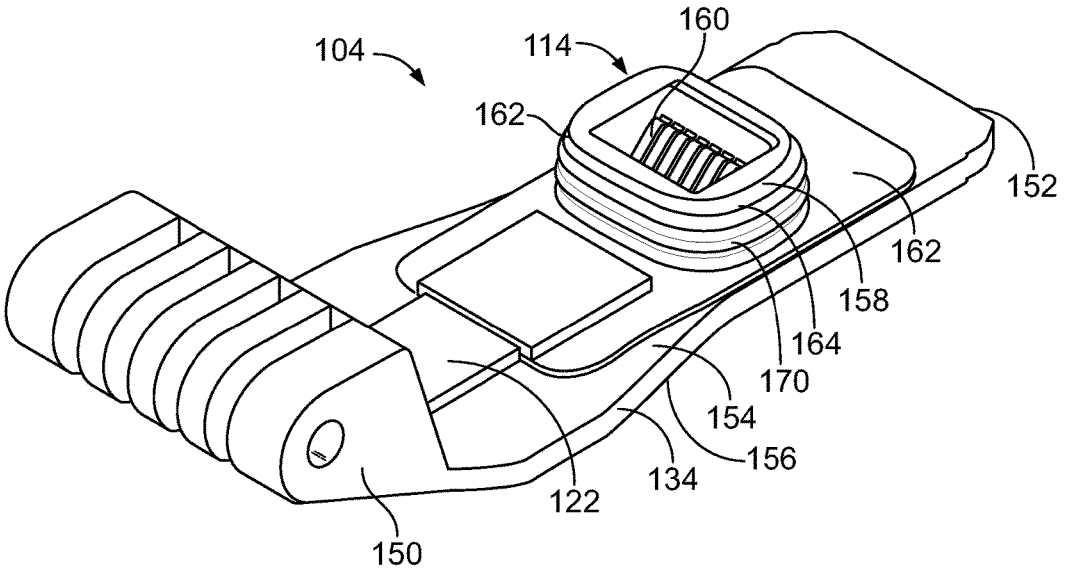
FIG. 11 is a top perspective view of a portion of the plug connector assembly in accordance with an exemplary embodiment.

FIG. 11 is a top perspective view of a portion of the plug connector assembly 104 in accordance with an exemplary embodiment. The support arm 134 and the plug connector 114 illustrated in FIG. 11 are similar to those illustrated in FIG. 4. However, the support arm 134 illustrated in FIG. 11 is shaped differently than the support arm 134 illustrated in FIG. 4 and the plug connector 114 illustrated in FIG. 11 is shaped differently than the plug connector 114 illustrated in FIG. 4. For example, the support arm 134 is L shaped rather than being C-shaped. The shroud 158 of the plug connector 114 is taller and configured to be plugged deeper into a receptacle. The shroud 158 of the plug connector 114 supports a taller seal 170 configured to be sealed in a different manner than the seal 170 shown in FIG. 4.

Figure 12:
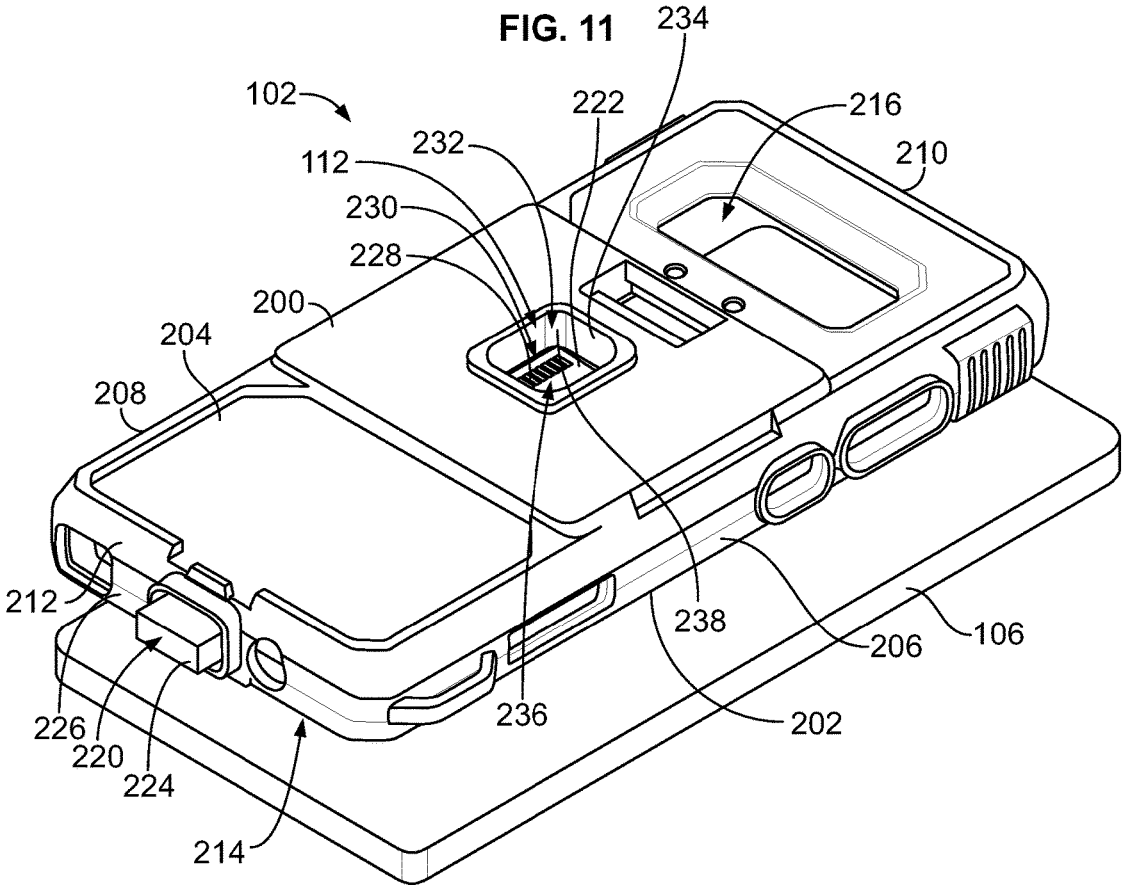
FIG. 12 is a rear perspective view of a portion of the receptacle connector assembly in accordance with an exemplary embodiment.

FIG. 12 is a rear perspective view of a portion of the receptacle connector assembly 102 in accordance with an exemplary embodiment. The receptacle connector 112 illustrated in FIG. 12 is similar to the receptacle connector 112 illustrated in FIG. 5; however, the receptacle connector 112 illustrated in FIG. 12 is sized and shaped for mating with the plug connector 112 shown in FIG. 11.

Figure 13:
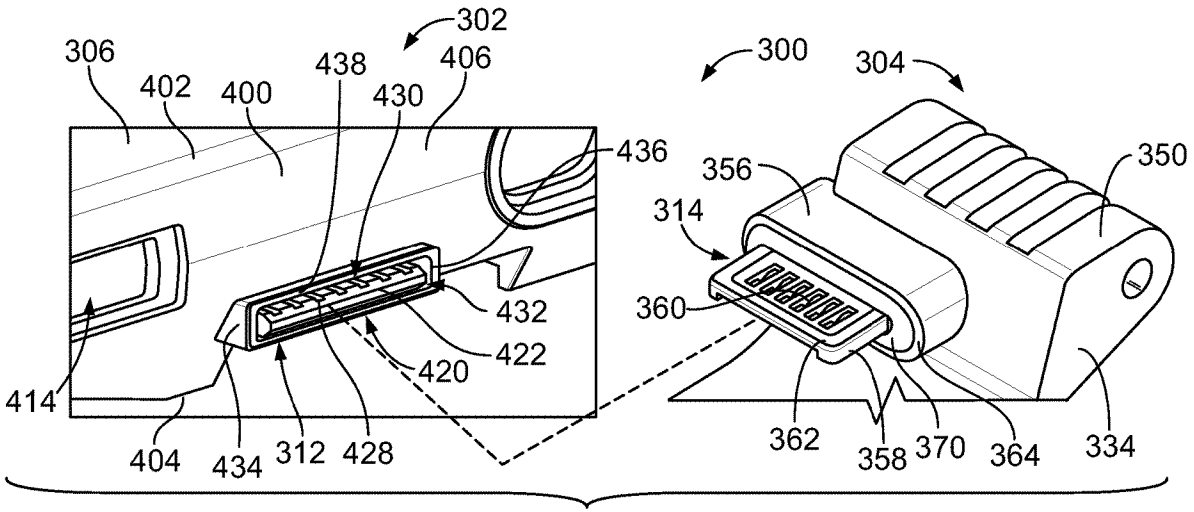
FIG. 13 illustrates a connector system in accordance with an exemplary embodiment.

FIG. 13 illustrates a connector system 300 in accordance with an exemplary embodiment. The connector system 300 is similar to the connector system 100 (shown in FIG. 1) and includes a receptacle connector assembly 302 and a plug connector assembly 304 that mate together to form an electrical and/or fiber optic connection therebetween. The receptacle connector assembly 302 and the plug connector assembly 304 mate differently than the embodiment illustrated in FIG. 1. For example, the receptacle connector assembly 302 and the plug connector assembly 304 are side mated rather than being rear mated and are shaped and located for such mating; however, the connector assemblies 302, 304 includes similar components as the connector assemblies 102, 104.

In an exemplary embodiment, the receptacle connector assembly 302 includes a receptacle connector 312 and the plug connector assembly 304 includes a plug connector 314. The plug connector 314 is electrically connected to the receptacle connector 312 when the plug connector assembly 304 is mated with the receptacle connector assembly 302. The plug connector 314 is provided on a support arm 334, which may be similar to the support arm 134. The support arm 334 includes a base 350. In the illustrated embodiment, the plug connector 314 is provided on the base 350.

The plug connector 314 includes a base 356 and a platform 358 extending from the base 356. The platform 358 defines a plug configured to be plugged into the receptacle connector 312. The plug connector 314 includes plug contacts 360 at a mating interface configured to be mated with the receptacle connector 312. In the illustrated embodiment, the plug contacts 360 extend along the platform 358. The plug contacts 360 may extend into the base 356 and/or into the base 350 for termination to the cable. In an exemplary embodiment, the plug contacts 360 include spring beams being deflectable and configured for mating with the receptacle connector 312. Other types of contacts may be provided in alternative embodiments, such as Pogo pins, pads, and the like. In other various embodiments, the plug connector 314 may include a circuit board having circuits defining the plug contacts 360.

In an exemplary embodiment, the plug connector 314 has space around the plug contacts 360 that allows removal of dirt and debris from the plug contacts 360. For example, the platform 358 may include openings 366 around the plug contacts 360 that allow removal of the dirt from around the plug contacts 360. A tool or cloth may be used to clean or wipe the plug contacts 360. Optionally, the plug connector 314 may be open below the plug contacts 360 to allow the dirt and debris to be ejected through the bottom such that the dirt and debris does not gather in the plug connector 314.

In an exemplary embodiment, the plug connector 314 includes an electrical shield 362 at least partially surrounding the plug contacts 360. The electrical shield 362 provides electrical shielding for the plug contacts 360 at the mating interface. The electrical shield 362 may be a machined, diecast, or stamped and formed shield. In alternative embodiments, the electrical shield 362 is defined by conductive plating.

The plug connector 314 has a seal surface 364 that may be sealed to provide a sealed interface with the receptacle connector 312. In the illustrated embodiment, the seal surface 364 is defined on the base 356 rearward of the platform 358. The plug connector assembly 304 includes a seal 370 at the seal surface 364. The platform 358 is cantilevered forward of the seal 370. The seal 370 provides a sealed mating interface for mating with the receptacle connector assembly 302. The seal 370 is configured to be engaged by the receptacle connector assembly 302. The seal 370 may be a rubber gasket. In an alternative embodiment, the seal 370 may be provided on the receptacle connector assembly 302 rather than the plug connector assembly 304.

The receptacle connector assembly 302 includes a housing 400 that receives the first electronic device 306. The housing 400 may be similar to the housing 200 (shown in FIG. 1). The housing 400 includes a top 402 and a bottom 404 opposite the top 402. The housing 400 includes a first side 406 between the top 402 and the bottom 404. The housing 400 includes a cavity 414 that receives the electronic device 306.

In an exemplary embodiment, the receptacle connector assembly 302 includes a connector assembly 420 providing an electrical interface between the plug connector assembly 304 and the electronic device 306. The connector assembly 420 includes the receptacle connector 312. In the illustrated embodiment, the receptacle connector 312 includes a printed circuit board 422; however, the receptacle connector 312 may include other electrical components, such as a flexible circuit, contacts, and the like. The printed circuit board 422 includes receptacle contacts 428 defining a mating interface 430 for mating with the plug connector assembly 304. For example, the receptacle contacts 428 may be defined by circuits, such as pads, traces or vias on the printed circuit board 422. Alternatively, the receptacle contacts 428 may be spring contacts or other types of contacts terminated to the printed circuit board 422.

The housing 400 includes a receptacle 432 at the bottom 404 for receiving the plug connector 314 of the plug connector assembly 304. The receptacle 432 is defined by sidewalls 434 extending to edges 436. In an exemplary embodiment, the receptacle 432 is open at the first side 406 of the housing 400 for side loading the plug connector 314 into the receptacle 432 in a direction generally parallel to the cavity 414. The receptacle 432 may be located at other positions and/or in other orientations in alternative embodiments. The edges 436 define a seal surface 438 configured to engage the seal 370 when the plug connector assembly 104 is coupled to the receptacle connector assembly 102.

Figure 14:
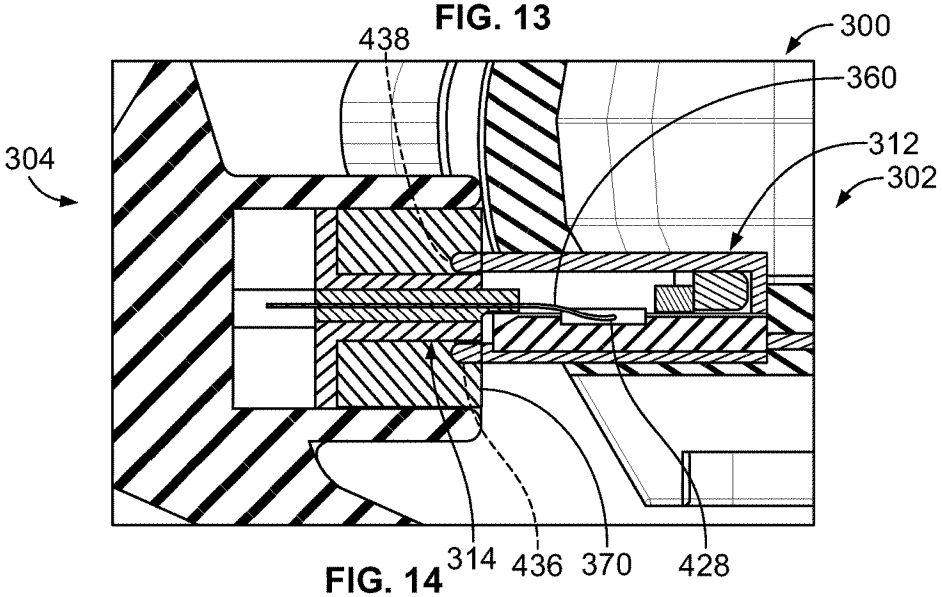
FIG. 14 is a cross-sectional view of the connector system shown in FIG. 13.

FIG. 14 is a cross-sectional view of the connector system 300 showing the plug connector assembly 304 mated with the receptacle connector assembly 302. When mated, the plug connector 314 is electrically connected with the receptacle connector 312. The plug contacts 360 are mated with the receptacle contacts 428. When mated, the seal surface 438 of the receptacle connector assembly 302 engages the seal 370. The seal 370 is compressed against the edge 436 to seal the mating interface.

Figure 15:
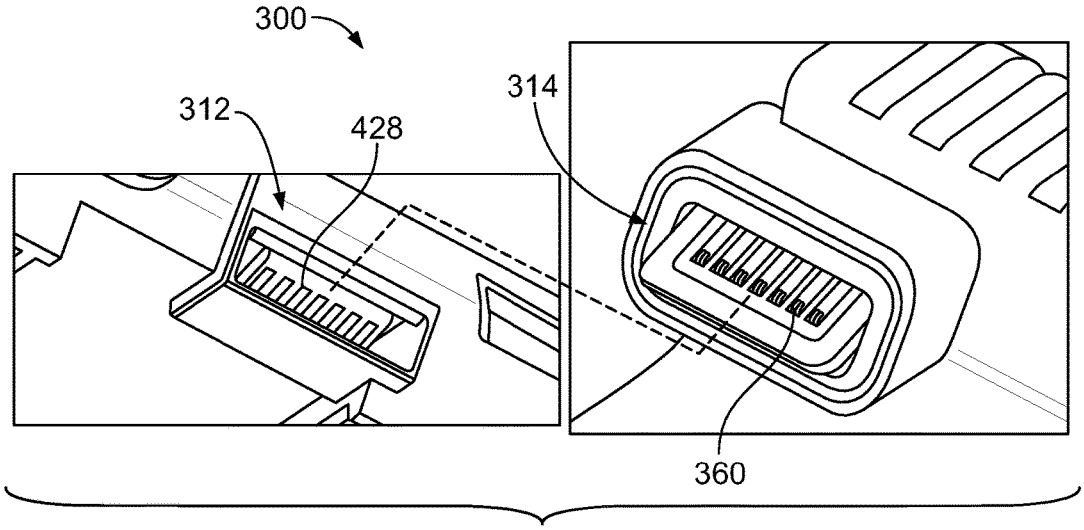
FIG. 15 illustrates a connector system in accordance with an exemplary embodiment.

FIG. 15 illustrates the connector system 300 in accordance with an exemplary embodiment. In the illustrated embodiment, the mating interface between the receptacle connector 312 and the plug connector 314 are angled rather than being vertical. The angled mating interface provides greater access to the plug contacts 360 and the receptacle contacts 428 for cleaning the plug contacts 360 and the receptacle contacts 428. The angled mating interface enlarges the area of the receptacle providing greater access to the receptacle to clean out debris from the receptacle.

Figure 16:
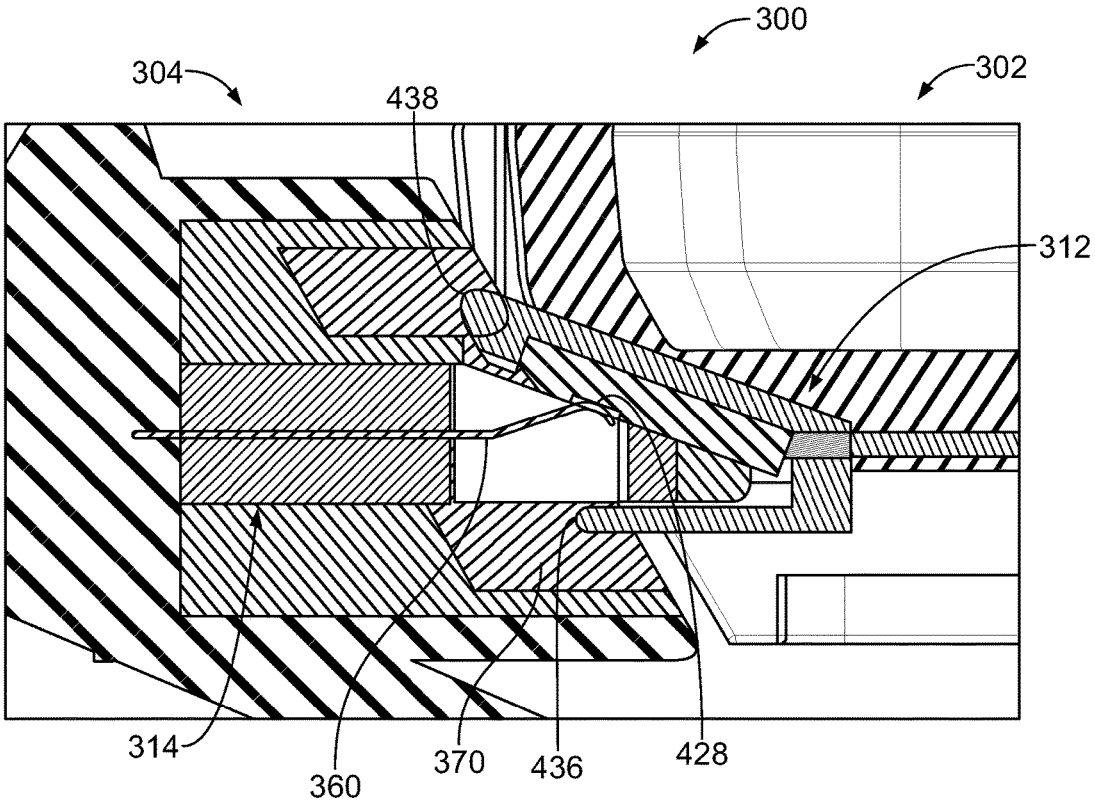
FIG. 16 is a cross-sectional view of the connector system shown in FIG. 15.

FIG. 16 is a cross-sectional view of the connector system 300 showing the plug connector assembly 304 mated with the receptacle connector assembly 302. When mated, the plug connector 314 is electrically connected with the receptacle connector 312. The plug contacts 360 are mated with the receptacle contacts 428 at the angled mating interface. When mated, the seal surface 438 of the receptacle connector assembly 302 engages the seal 370 at the angled mating interface. The seal 370 is compressed against the edge 436 to seal the mating interface.

Figure 17:
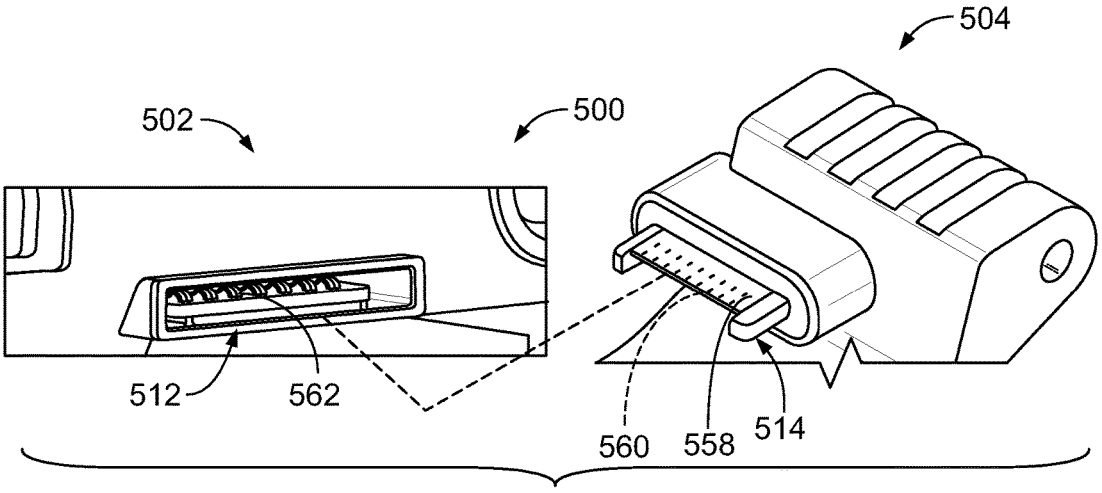
FIG. 17 illustrates a connector system in accordance with an exemplary embodiment.

FIG. 17 illustrates a connector system 500 in accordance with an exemplary embodiment. The connector system 500 is similar to the connector system 300 (shown in FIG. 13) and includes a receptacle connector assembly 502 and a plug connector assembly 504 that mate together to form an electrical and/or fiber optic connection therebetween. The receptacle connector assembly 502 and the plug connector assembly 504 are similar to the receptacle connector assembly 302 and the plug connector assembly 304; however the mating interfaces and contacts are different.

In an exemplary embodiment, the receptacle connector assembly 502 includes a receptacle connector 512 and the plug connector assembly 504 includes a plug connector 514. The plug connector 514 is electrically connected to the receptacle connector 512 when the plug connector assembly 504 is mated with the receptacle connector assembly 502. The plug connector 514 includes a printed circuit board 558 having plug contacts 560 defined by circuits of the printed circuit board 558. The receptacle connector 512 includes receptacle contacts 562 defined by spring beams configured to be mated to the printed circuit board 558 when the plug connector 514 is plugged into the receptacle connector 512.

Figure 18:
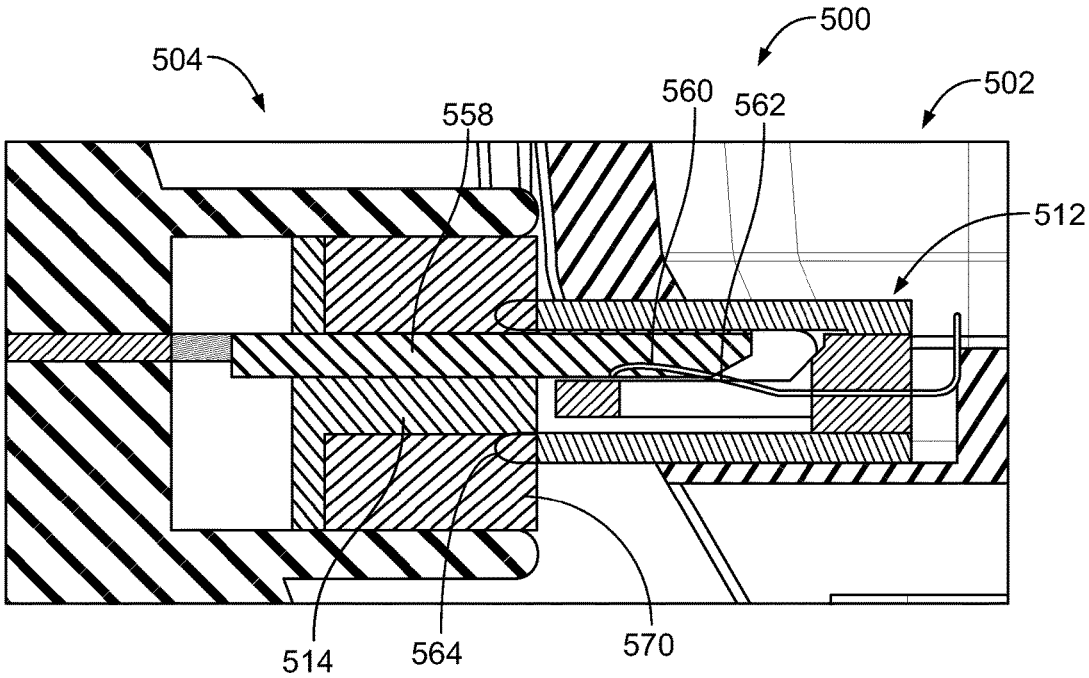
FIG. 18 is a cross-sectional view of the connector system shown in FIG. 17.

FIG. 18 is a cross-sectional view of the connector system 500 showing the plug connector assembly 504 mated with the receptacle connector assembly 502. When mated, the plug connector 514 is electrically connected with the receptacle connector 512. The printed circuit board 558 is plugged into the receptacle connector 512. The plug contacts 560 are mated with the receptacle contacts 562. When mated, a seal surface 564 of the receptacle connector assembly 502 engages a seal 570. The seal 570 is compressed against the edge of the receptacle connector 512 to seal the mating interface.

Figure 19:
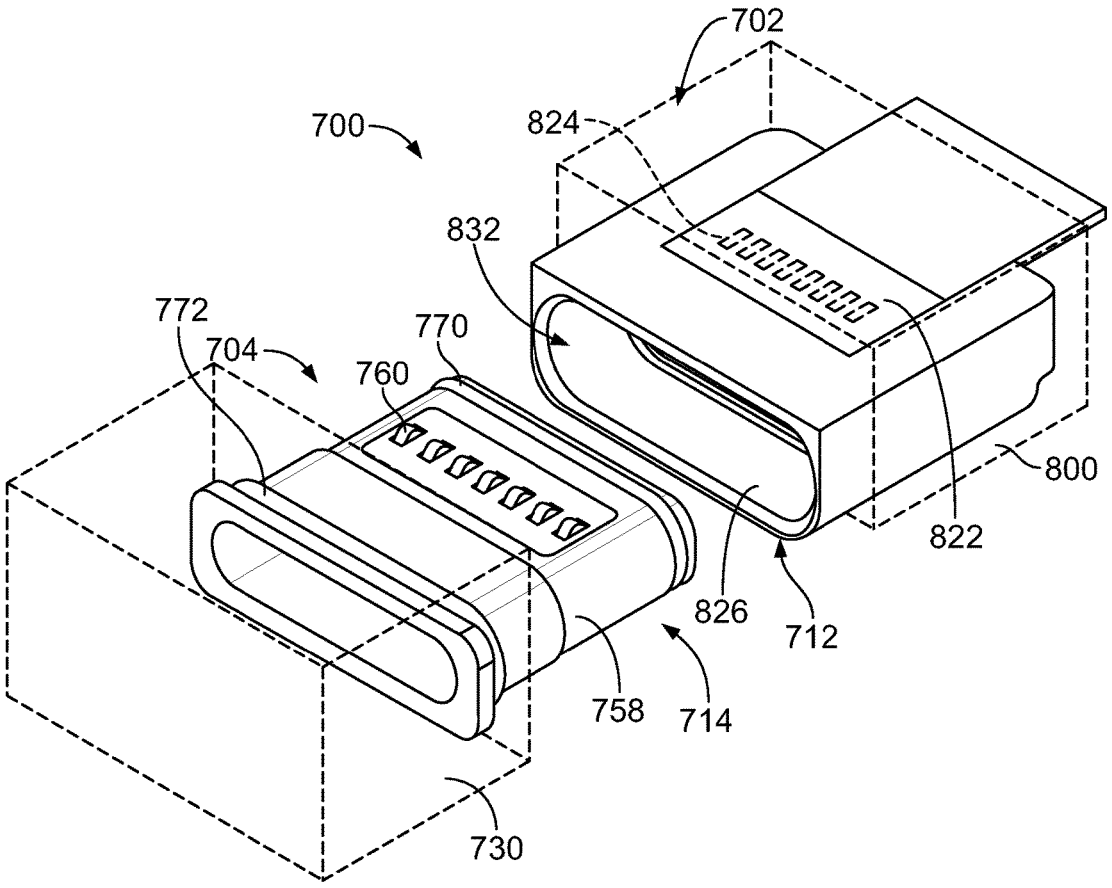
FIG. 19 illustrates a connector system in accordance with an exemplary embodiment.

FIG. 19 illustrates a connector system 700 in accordance with an exemplary embodiment. The connector system 700 is similar to the connector system 100 (shown in FIG. 1) and includes a receptacle connector assembly 702 and a plug connector assembly 704 that mate together to form an electrical and/or fiber optic connection therebetween. The receptacle connector assembly 702 and the plug connector assembly 704 are similar to the receptacle connector assembly 102 and the plug connector assembly 104; however the mating interfaces and contacts are different.

In an exemplary embodiment, the receptacle connector assembly 702 includes a receptacle connector 712 and the plug connector assembly 704 includes a plug connector 714. The plug connector 714 is electrically connected to the receptacle connector 712 when the plug connector assembly 704 is mated with the receptacle connector assembly 702. The plug connector 714 is configured to be mounted to a holder 730. In the illustrated embodiment, the plug connector includes seals 770, 772 along a plug shroud 758. Plug contacts 760 are arranged along the plug shroud 758.

The receptacle connector 712 includes a receptacle 832 configured to be coupled to or formed in a housing 800. The receptacle 832 holds a printed circuit board 822 having receptacle contacts 824. The receptacle 832 receives the plug connector 714. Interior surfaces of the receptacle 832 define seal surfaces 826 of the receptacle connector 712.

Figure 20:
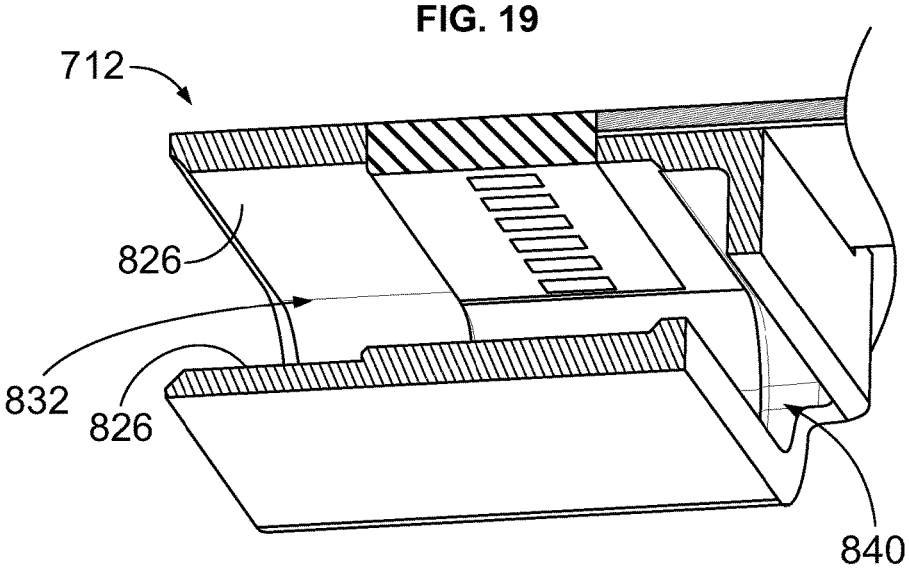
FIG. 20 is a cross-sectional view of a receptacle connector of the connector system shown in FIG. 19 in accordance with an exemplary embodiment.

FIG. 20 is a cross-sectional view of the receptacle connector 712 in accordance with an exemplary embodiment. The receptacle 832 includes an opening 840 and a back end of the receptacle 832. When the plug connector 714 is loaded into the receptacle 832, the plug connector 714 may force debris out of the receptacle 832 through the opening 840. The seals 770, 772 may seal against the seal surfaces 826. The seals 770, 772 may wipe against the seal surfaces 826 to clean the debris from the receptacle 832.

Figure 21:
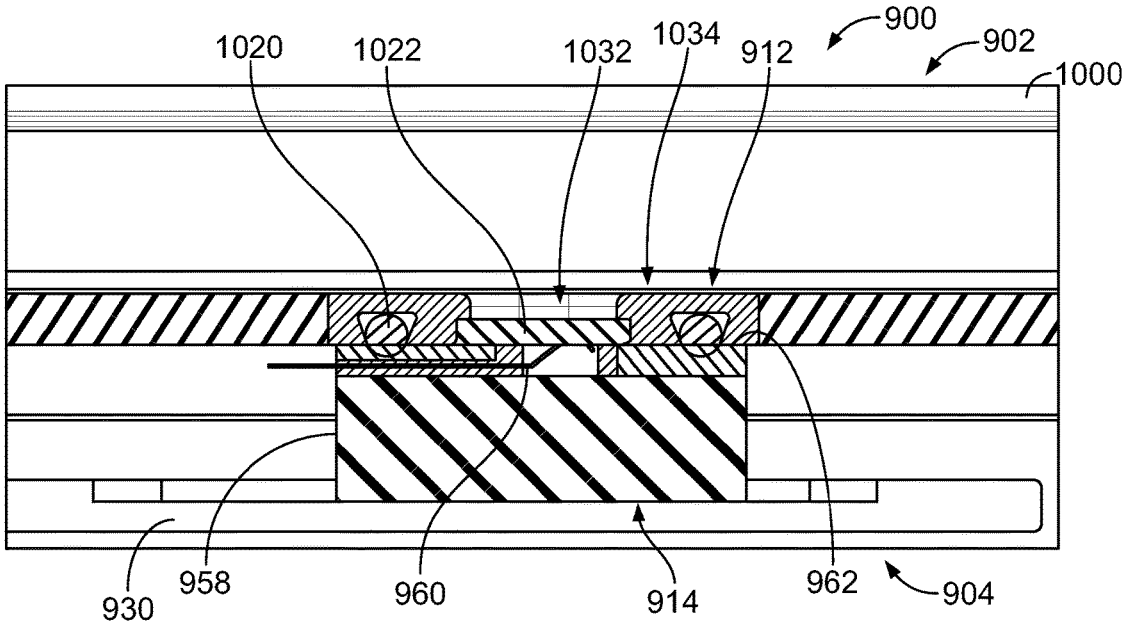
FIG. 21 is a cross-sectional view of a connector system in accordance with an exemplary embodiment.

FIG. 21 is a cross-sectional view of a connector system 900 in accordance with an exemplary embodiment. The connector system 900 is similar to the connector system 100 (shown in FIG. 1) and includes a receptacle connector assembly 902 and a plug connector assembly 904 that mate together to form an electrical and/or fiber optic connection therebetween. The receptacle connector assembly 902 and the plug connector assembly 904 are similar to the receptacle connector assembly 102 and the plug connector assembly 104; however the mating interfaces and contacts are different.

In an exemplary embodiment, the receptacle connector assembly 902 includes a receptacle connector 912 and the plug connector assembly 904 includes a plug connector 914. The plug connector 914 is electrically connected to the receptacle connector 912 when the plug connector assembly 904 is mated with the receptacle connector assembly 902. The plug connector 914 is configured to be mounted to a holder 930. In the illustrated embodiment, the plug connector 914 includes a plug shroud 958 having plug contacts 960 along a top of the plug shroud 958. The top of the plug shroud 958 defines a seal surface 962.

The receptacle connector 912 includes a receptacle 1032 configured to be coupled to or formed in a housing 1000. The receptacle 1032 holds a receptacle assembly 1034 including a printed circuit board 1022 and a seal 1020. The seal 1020 may be a perimeter seal that surrounds the printed circuit board 1022. The plug connector 914 is coupled to the receptacle connector 912 to interface with the printed circuit board 1022 and the seal 1020, such as from the bottom of the receptacle connector 912.

Figure 22:
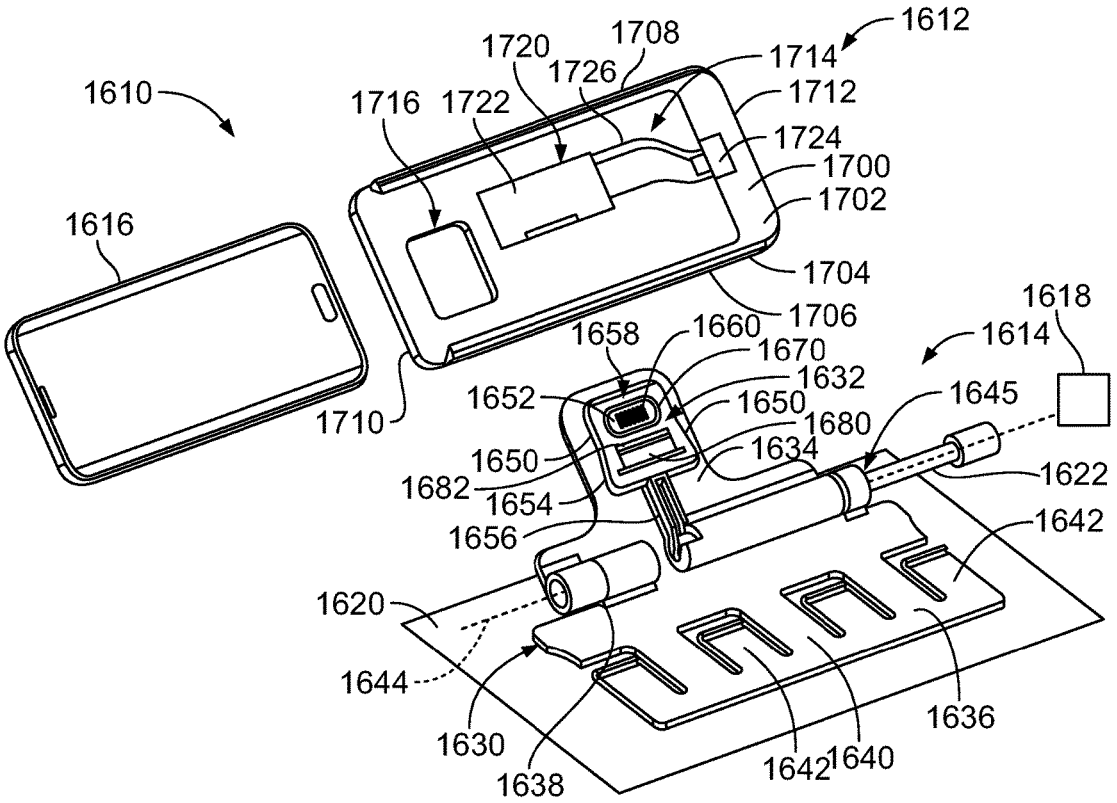
FIG. 22 is a perspective view of a connector system in accordance with an exemplary embodiment.

FIG. 22 is a perspective view of an exemplary embodiment of a connector system 1610 in accordance with an exemplary embodiment. The connector system 1610 may be similar to the connector system 100 (shown in FIG. 1). The connector system 1610 includes a receptacle connector assembly 1612 and a plug connector assembly 1614 that mate together to form an electrical and/or fiber optic connection therebetween. The receptacle connector assembly 1612 may be similar to the receptacle connector assembly 102 shown in FIG. 1 and the plug connector assembly 1614 may be similar to the plug connector assembly 104 shown in FIG. 1 and may include similar components and features, respectively.

The connector system 1610 is provided along an electrical and/or fiber optic path between two electronic devices 1616 and 1618 for providing a separable electrical and/or fiber optic connection between the devices. The connector system 1610 is optionally mounted to any type of wearable article 1620, such as, but not limited to, a vest, a shirt, a jacket, pants, trousers, a boot, a shoe, a helmet, a hat, a cap, a coat, armor, and/or the like worn by an operator, such as military personnel, a first responder, and the like utilizing wearable technology, such as e-textiles. The connector system 1610 may be configured to operate at any standard, protocol, and/or the like, such as, but not limited to, USB 1.0, USB 2.0, USB 3.0, CAN-BUS, GIGA-BIT ETHERNET, and/or the like. The connector system 1610 may be scalable to a variety of different sizes. In an exemplary embodiment, the connector system 1610 is used to electrically connect a cell phone (first electronic device 1616) with another component worn by the operator.

The devices 1616 and 1618 each may be any type of electronic, fiber optic, and/or other type of device. In one exemplary embodiment, the device 1616 is a portable electronic device, such as a cell phone and the device 1618 is a battery pack. Other types of devices may be interconnected by the connector system 1610 in other embodiments.

In the illustrated embodiment, the plug connector assembly 1614 terminates one or more cables 1622 of the wearable article 1620. The cables 1622 connect the plug connector assembly 1614 to the device 1618 and are worn by the operator. In the illustrated embodiment, the cable 1622 is separate from the wearable article 1620; however the cable 1622 may be embedded in the wearable article 1620. In other embodiments, the cable 1622 may be an e-textile that includes embedded electrical fabrics that enable computing, digital components, electrical pathways, fiber optic pathways, and/or electronic and/or fiber optic devices to be embedded therein. Specifically, the e-textile provides the wearable article 1620 with wearable technology that allows for the incorporation of built-in technological elements into the fabric of the wearable article 1620. The wearable article 1620 may constitute intelligent clothing or smart clothing. The plug connector assembly 1614 is mounted to the wearable article 1620. For example, the wearable article 1620 may be clothing. In other various embodiments, the wearable article 1620 may be a strap, belt or other component that supports the plug connector assembly 1614. The wearable article 1620 may be a backpack or other component carried by the operator.

The plug connector assembly 1614 includes a holder 1630 supporting a connector housing 1632 having a mating interface for mating with the receptacle connector assembly 1612. In the illustrated embodiment, the holder 1630 includes multiple pieces movable relative to each other. For example, the holder 1630 includes a support arm 1634 and an article mount 1636 hingedly coupled to the support arm 1634 at a hinge 1638. The article mount 1636 may be a clip configured to be mounted to the wearable article 1620. The support arm 1634 supports the connector housing 1632. Optionally, the support arm 1634 and the connector housing 1632 may be integral with each other. Alternatively, the connector housing 1632 may be separate and discrete from the support arm 1634 and mounted or secured to the support arm 1634.

The article mount 1636 includes a base 1640 and clipping fingers 1642 movable relative to the base 1640. The clipping fingers 1642 are used to secure the holder 1630 to the wearable article 1620. In an exemplary embodiment, the base 1640 in the clipping fingers 1642 may be released from the wearable article 1620 to remove the plug connector assembly 1614 from the wearable article 1620. Alternatively, the article mount 1636 may be integrated into the wearable article 1620. For example, the article mount 1636 may be sown into one or more layers of the wearable article 1620.

The hinge 1638 extends along a hinge axis 1644. The support arm 1634 is rotatably coupled to the article mount 1636 at the hinge 1638. Optionally, the hinge 1638 may be hollow and define a cable channel 1646 that receives the cable 1622. As such, the cable 1622 is routed along the hinge axis 1644. The cable 1622 is protected and the cable channel 1646, such as from snagging. Additionally, the cable 1622 does not restrict opening and closing of the support arm 1634 and does not bind when the support arm 1634 is opened and closed. Additionally, routing the cable 1622 and the cable channel 1646 prevents over bending of the cable 1622 beyond a bend limit of the cable 1622 by controlling routing of the cable 1622 away from the connector housing 1632.

The connector housing 1632 includes sidewalls 1650 extending from the support arm 1634 to a mating surface 1652. Optionally, the mating surface 1652 may be planar. The mating surface 1652 may be oriented parallel to the support arm 1634. Alternatively, the mating surface 1652 may be angled relative to the support arm 1634 for mating with the receptacle connector assembly 1612. In an exemplary embodiment, the sidewalls 1650 include shoulders 1654 spaced apart from and facing the support arm 1634.

Channels are defined between the shoulders 1654 and the support arm 1634 that receive a portion of the receptacle connector assembly 1612 to secure the receptacle connector assembly 1612 to the plug connector assembly 1614. Optionally, portions of the sidewalls 1650 may be angled such that the connector housing 1632 is narrower at the front and wider at the rear of the connector housing 1632, such as to provide lead-in during mating with the receptacle connector assembly 1612. In the illustrated embodiment, the connector housing 1632 includes a cable guide 1656 extending rearward from the connector housing 1632. The cable guide 1656 guides the cable 1622 from the connector housing 1632. The cable guide 1656 guides the cable 1622 to the cable channel 1646.

The plug connector assembly 1614 includes plug contacts 1660 at the mating surface 1652. The plug contacts 1660 and the connector housing 1632 define a plug connector 1658 of the plug connector assembly 1614 configured to be mated with a receptacle connector of the receptacle connector assembly 1612. The plug contacts 1660 are configured to be electrically connected to the receptacle connector assembly 1612. The plug contacts 1660 are electrically connected to the cable 1622. In an exemplary embodiment, the plug contacts 1660 include spring beams being deflectable and configured for mating with the receptacle connector assembly 1612. Other types of contacts may be provided in alternative embodiments, such as Pogo pins, pads, and the like.

The plug connector assembly 1614 includes a seal 1670 at the mating surface 1652. The seal 1670 surrounds the plug contacts 1660 to provide a sealed mating interface for mating with the receptacle connector assembly 1612. The seal 1670 is a perimeter seal extending entirely around the perimeter of mating interface. The seal 1670 may be a rubber gasket. In an alternative embodiment, the seal 1670 may be provided on the receptacle connector assembly 1612 rather than the plug connector assembly 1614.

The plug connector assembly 1614 includes a latching feature 1680 for latchably securing the plug connector assembly 1614 to the receptacle connector assembly 1612. In the illustrated embodiment, the latching feature 1680 is a deflectable latch having a latching surface 1682. The plug connector assembly 1614 may include a release mechanism, such as a push button or a pull tab to release the latching feature 1680 from the receptacle connector assembly 1612, such as for releasing the receptacle connector assembly 1612 from the plug connector assembly 1614.

Figure 23:
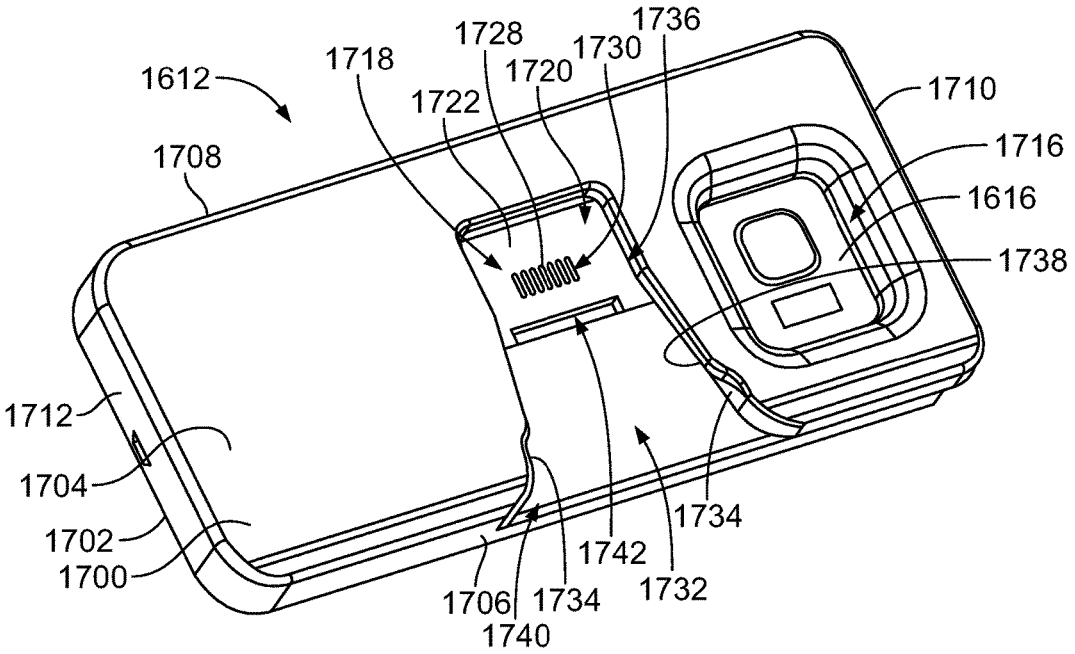
FIG. 23 is a rear perspective view of a receptacle connector assembly of the connector system shown in FIG. 22.

With additional reference to FIG. 23, which is a rear perspective view of the receptacle connector assembly 1612, the receptacle connector assembly 1612 includes a housing 1700 configured to receive the first electronic device 1616. The housing 1700 includes a top 1702 and a bottom 1704 opposite the top 1702. The housing 1700 includes a first side 1706 and a second side 1708 opposite the first side 1706. The housing 1700 includes a first end 1710 and a second end 1712 opposite the first end 1710.

The housing 1700 includes a cavity 1714 that receives the electronic device 1616. The cavity 1714 may be open at the top 1702 and/or the first end 1710 for receiving the electronic device 1616. In an exemplary embodiment, the cavity 1714 is open at the top 1702 to access the electronic device 1616 when the electronic device 1616 is received in the housing 1700. For example, in the illustrated embodiment, the electronic device 1616 is a cell phone and the touchscreen of the cell phone is accessible through the top 1702. In an exemplary embodiment, the housing 1700 includes a window 1716 at the bottom 1704. The window 1716 provides access to the electronic device 1616. For example, the window 1716 may provide access for a camera, a flash or another feature of the electronic device 1616.

In an exemplary embodiment, the receptacle connector assembly 1612 includes a connector assembly 1720 providing an electrical interface between the plug connector assembly 1614 and the electronic device 1616. In the illustrated embodiment, the connector assembly 1720 includes a receptacle connector 1718 including a printed circuit board 1722, a mating connector 1724 and a cable 1726 connecting the printed circuit board 1722 and the mating connector 1724. The receptacle connector 1718 is configured to be electrically connected to the plug connector 1658. The cable 1726 may be a jacketed cable having one or more wires therein. Alternatively, the cable 1726 may be a flat cable, such as a flex circuit. In alternative embodiments, rather than having a cable between the printed circuit board 1722 and the mating connector 1724, the mating connector 1724 may be mounted directly to the printed circuit board 1722. The mating connector 1724 has a mating interface for electrical connection with the electronic device 1616, such as a cell phone interface, a USB interface, and the like. The printed circuit board 1722 may include circuitry and/or electrical components for processing signals and/or power between the cable 1622 and the electronic device 1616. In an exemplary embodiment, the printed circuit board 1722 includes contacts 1728 defining a mating interface 1730 for mating with the plug connector assembly 1614. For example, the contacts 1728 may be pads on the printed circuit board 1722. Alternatively, the contacts 1728 may be spring contacts or other types of contacts terminated to the printed circuit board 1722. In alternative embodiments, rather than using a printed circuit board 1722, the housing 1700 may hold a mating connector for mating with the plug connector assembly 1614.

The housing 1700 includes a plug channel 1732 at the bottom 1704 for receiving the connector housing 1632 of the plug connector assembly 1614. The plug channel 1732 is defined by sidewalls 1734. In an exemplary embodiment, the plug channel 1732 is open at the first side 1706 of the housing 1700 to receive the connector housing 1632 in a side loading direction. The loading direction may be perpendicular to the mating direction of the contacts 1728 with the plug contacts 1660.

The housing 1700 includes an opening 1736 that provides access to the printed circuit board 1722. The contacts 1728 are exposed in the opening 1736 for mating with the plug connector assembly 1614. In an exemplary embodiment, the sidewalls 1734 include lips 1738 having channels above the lips 1738 that receive portions of the plug connector assembly 1614 for securing the plug connector assembly 1614 in the plug channel 1732. The lips 1738 are configured to engage the shoulders 1654 to secure the connector housing 1632 in the plug channel 1732. In an exemplary embodiment, the plug channel 1732 includes a lead-in 1740 to guide the connector housing 1632 into the plug channel 1732. The plug channel 1732 is wider at the lead-in 1740 and narrower at the mating interface 1730. The lead-in 1740 makes blind mating of the receptacle connector assembly 1612 with the plug connector assembly 1614 easier.

In an exemplary embodiment, the receptacle connector assembly 1612 includes a latching feature 1742 for interfacing with the latching feature 1680 of the plug connector assembly 1614 to secure the plug connector assembly 1614 to the receptacle connector assembly 1612. In the illustrated embodiment, the latching feature 1742 is a catch surface defined by the opening 1736. Other types of latching features 1742 may be used in alternative embodiments. The latching features 1742, 1680 allow the receptacle connector assembly 1612 to clip onto the holder 1630 of the plug connector assembly 1614. When the latching features 1742, 1680 latchably couple, the plug contacts 1660 are mated to the contacts 1728 to create an electrical connection between the receptacle connector assembly 1612 and the plug connector assembly 1614.

Figure 24:
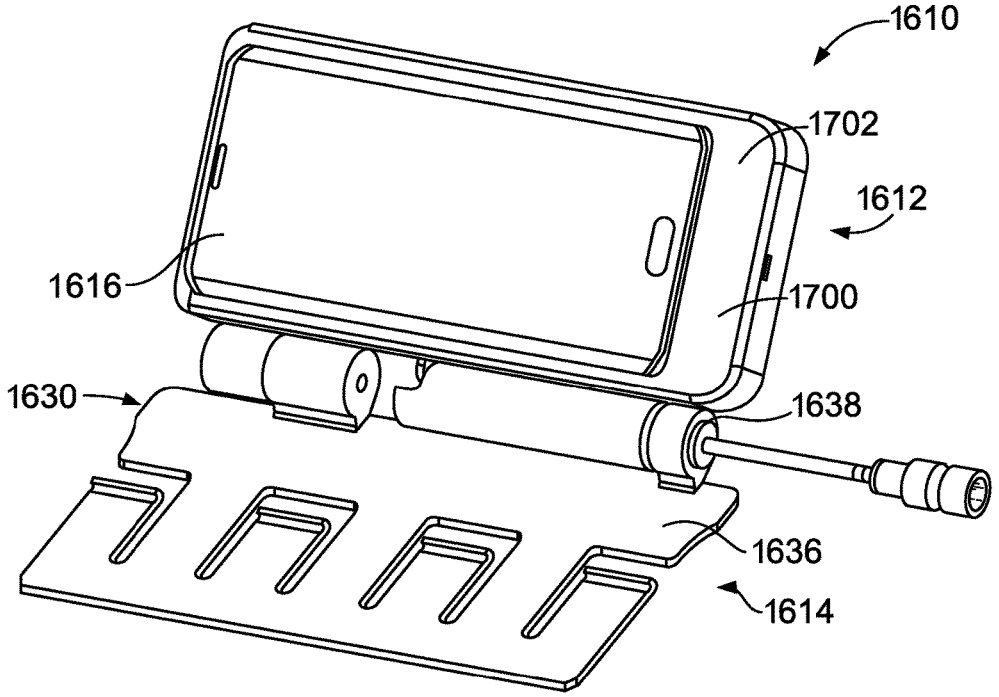
FIG. 24 is a perspective view of the connector system shown in FIG. 22.
Figure 25:
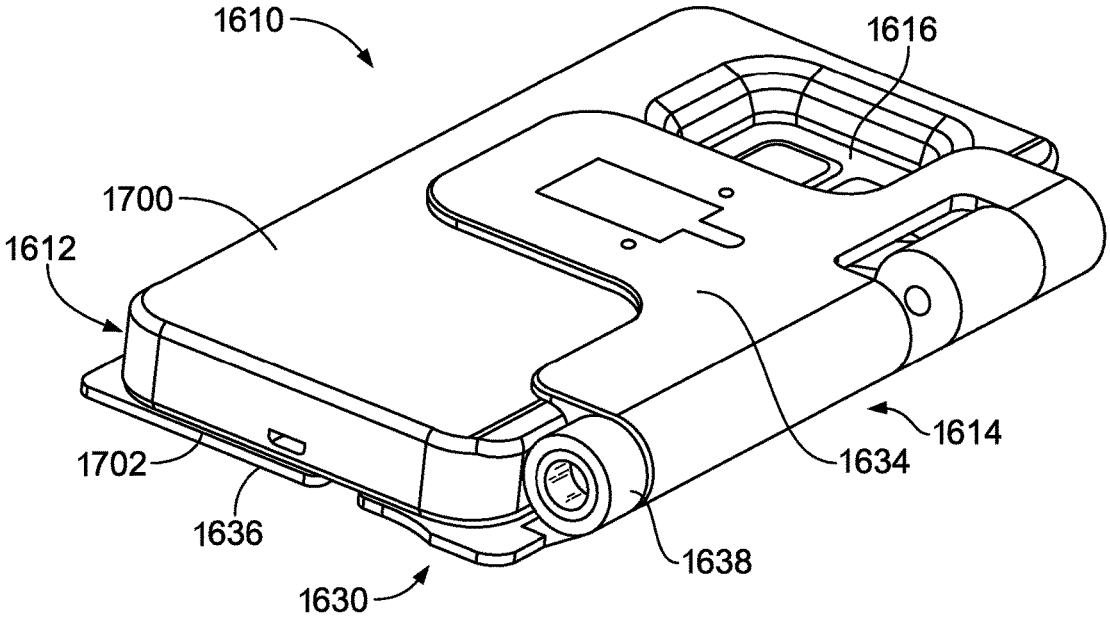
FIG. 25 is a perspective view of the connector system shown in FIG. 22.

FIG. 24 is a perspective view of the connector system 1610 showing the receptacle connector assembly 1612 coupled to the plug connector assembly 1614 and showing the connector system 1610 in an open position. FIG. 25 is a perspective view of the connector system 1610 showing the receptacle connector assembly 1612 coupled to the plug connector assembly 1614 and showing the connector system 1610 in a closed position. The holder 1630 is rotated at the hinge 1638 to open the support arm 1634 relative to the article mount 1636. When the connector system 1610 is open, the electronic device 1616 is accessible. For example, the touchscreen of the cell phone may be accessed through the top 1702 of the housing 1700 of the receptacle connector assembly 1612. When the connector system 1610 is closed, the electronic device 1616 may be an accessible, such as being closed against the article mount 1636. The connector system 1610 may be closed to protect the electronic device 1616.

Figure 26:
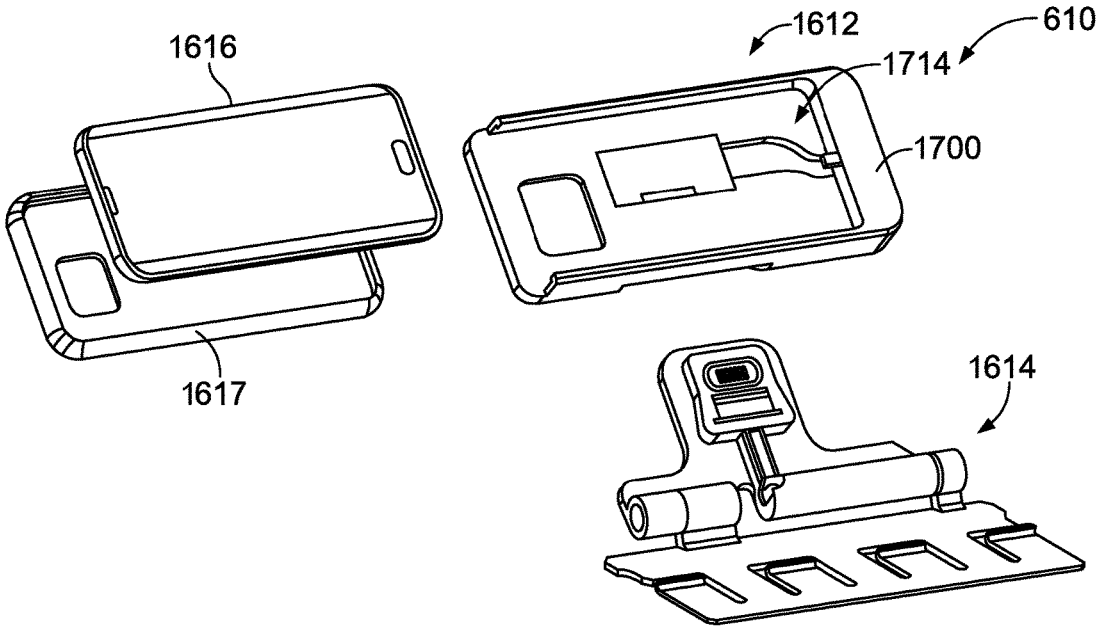
FIG. 26 is an exploded view of a connector system in accordance with an exemplary embodiment.
Figure 27:
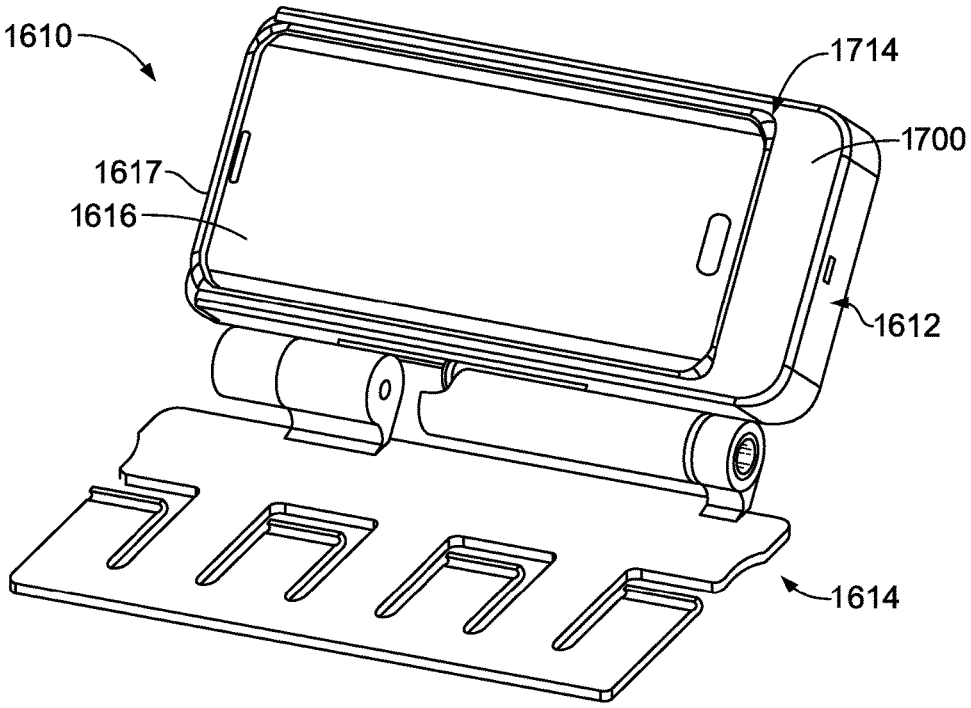
FIG. 27 is a perspective view of the connector system shown in FIG. 26.

FIG. 26 is an exploded view of the connector system 1610 in accordance with an exemplary embodiment. FIG. 27 is a perspective view of the connector system 1610 showing the receptacle connector assembly 1612 mated with the plug connector assembly 1614 in the open position. In the illustrated embodiment, the electronic device 1616 includes a case 1617 receiving the electronic device 1616. The case 1617 may protect the electronic device 1616. The case 1617 and the electronic device 1616 are configured to be loaded into the cavity 1714 of the housing 1700 of the receptacle connector assembly 1612. The receptacle connector assembly 1612, including the case 1617 and the electronic device 1616 are configured to be mated with the plug connector assembly 1614.

Figure 28:
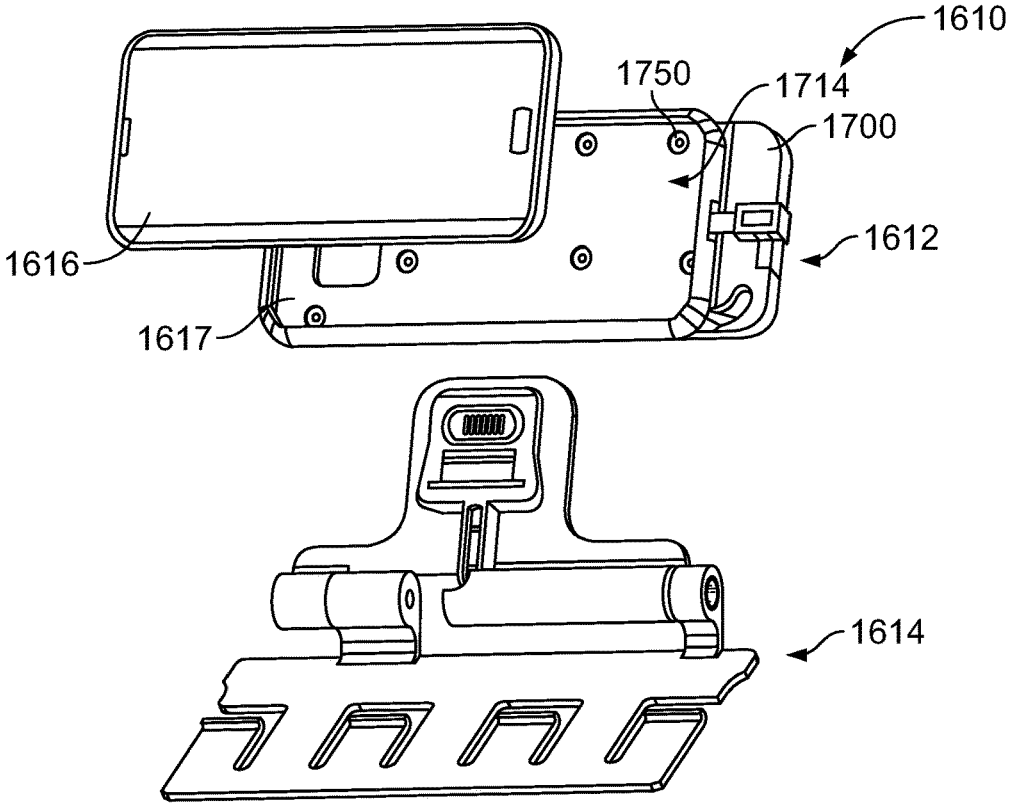
FIG. 28 is an exploded view of a connector system in accordance with an exemplary embodiment.
Figure 29:
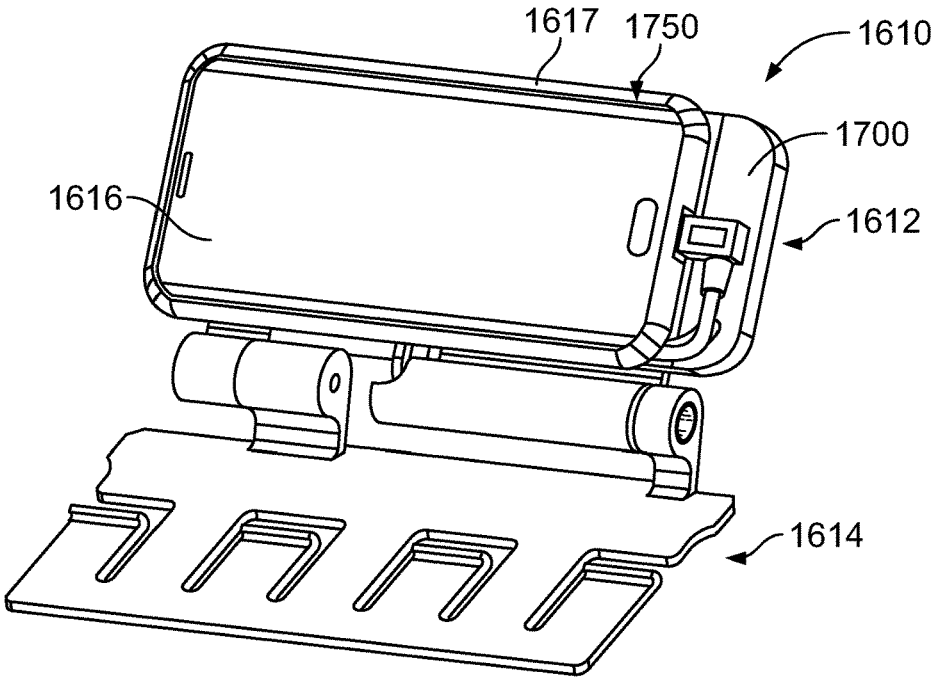
FIG. 29 is a perspective view of the connector system shown in FIG. 28.

FIG. 28 is an exploded view of the connector system 1610 in accordance with an exemplary embodiment. FIG. 29 is a perspective view of the connector system 1610 showing the receptacle connector assembly 1612 mated with the plug connector assembly 1614 in the open position. The electronic device 1616 includes the case 1617 used to protect the electronic device 1616. In the illustrated embodiment, the case 1617 is mounted to the housing 1700, such as using fasteners 1750, and the electronic device 1616 is configured to be loaded into and removed from the case 1617 without removing the case 1617 from the housing 1700. In the illustrated embodiment, the case 1617 defines the cavity 1714 of the receptacle connector assembly 1612 that receives the electronic device 1616. The receptacle connector assembly 1612, including the case 1617 and the electronic device 1616 are configured to be mated with the plug connector assembly 1614.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A connector system for a wearable article, the connector system comprising:

a receptacle connector assembly comprising a housing having a cavity configured to removably receive an electronic device, the receptacle connector assembly having a receptacle connector adjacent to the cavity configured to be electrically connected to the electronic device when received in the cavity, the receptacle connector having a receptacle, the receptacle connector having receptacle contacts in the receptacle being electrically connecting to the electronic device, the receptacle connector having a seal surface;

a plug connector assembly comprising a holder including an article mount configured to be secured to the wearable article and a support arm hingedly coupled to the article mount at a hinge of the holder, the plug connector assembly having a plug connector on the support arm, the plug connector including plug contacts, the plug connector including a seal surface, the plug connector having a cable electrically connected to the plug contacts and extending from the connector housing; and a seal coupled to one of the receptacle connector or the plug connector at the corresponding seal surface and engaging the other of the receptacle connector and the plug connector at the corresponding seal surface;

wherein the plug connector is loaded into the receptacle of the receptacle connector to mate the plug contacts with the receptacle contacts to electrically connect the cable to the electronic device through the plug contacts and the receptacle contacts;

wherein the support arm is docked in the housing and releasably secured to the housing to secure the plug connector to the receptacle connector.

2. The connector system of claim 1, wherein the plug connector includes a plug shroud surrounding the plug contacts, seal being a perimeter seal surrounding an exterior of the plug shroud.

3. The connector system of claim 1, wherein the plug connector includes a base and a platform extending from the platform, the contacts extending along the platform, the base holding the seal, the receptacle connector having a mating edge defining the seal surface configured to engage the seal when the platform is plugged into the receptacle.

4. The connector system of claim 1, wherein the receptacle connector includes a printed circuit board in the receptacle, the printed circuit board having circuits defining the receptacle contacts, the plug contacts having spring beams configured to be spring biased against the receptacle contacts.

5. The connector system of claim 1, wherein the plug connector includes a printed circuit board having circuits defining the plug contacts, the printed circuit board configured to be plugged into the receptacle, the receptacle contacts having spring beams configured to be spring biased against the plug contacts.

6. The connector system of claim 1, wherein at least one of the plug connector and the receptacle connector includes an electrical shield providing electrical shielding for the mating interface between the plug contacts and the receptacle contacts.

7. The connector system of claim 1, wherein the receptacle includes a window allowing debris to be ejected from the receptacle.

8. The connector system of claim 1, wherein the plug connector is side loaded into the receptacle parallel to the cavity.

9. The connector system of claim 1, wherein the plug connector is rear loaded into the receptacle perpendicular to the cavity.

10. The connector system of claim 1, wherein the cable exits the holder through the hinge.

11. The connector system of claim 10, wherein the hinge extends along a hinge axis, the cable being routed through the hinge along the hinge axis.

12. The connector system of claim 1, wherein the article mount includes a clip for mounting the holder to the wearable article.

13. The connector system of claim 1, wherein the cable includes a flex circuit.

14. The connector system of claim 1, wherein the receptacle connector assembly includes a mating connector held by the housing in the cavity for interfacing with the electronic device, the mating connector being electrically connected to the receptacle contacts.

15. The connector system of claim 1, wherein the cavity is open at a top of the housing to receive the electronic device, the receptacle being provided at a bottom of the housing.

16. The connector system of claim 1, wherein the housing includes a mounting plate, the electronic device being mounted to the mounting plate.

17. The connector system of claim 1, wherein the housing includes a window exposing the electronic device through the window.

* * * * *